US010364062B2

(12) United States Patent
Bressan et al.

(10) Patent No.: US 10,364,062 B2
(45) Date of Patent: Jul. 30, 2019

(54) CHILD-PROOF CONTAINERS AND RELATED METHODS

(71) Applicant: I.G.B. S.R.L., Milan (IT)

(72) Inventors: Michel Bressan, Induno Olona (IT); Alberto Gandolla, Induno Olona (IT)

(73) Assignee: I.G.B. S.r.l., Milan (IT)

( * ) Notice: Subject to any disclaimer, the term of this patent is extended or adjusted under 35 U.S.C. 154(b) by 0 days.

(21) Appl. No.: 15/735,288

(22) PCT Filed: May 20, 2016

(86) PCT No.: PCT/IB2016/052967

§ 371 (c)(1),
(2) Date: Dec. 11, 2017

(87) PCT Pub. No.: WO2016/198978

PCT Pub. Date: Dec. 15, 2016

(65) Prior Publication Data

US 2018/0162587 A1 Jun. 14, 2018

(30) Foreign Application Priority Data

Jun. 12, 2015 (IT) ..... 102015000023288

(51) Int. Cl.
*B65D 5/02* (2006.01)
*B65D 5/66* (2006.01)

(52) U.S. Cl.
CPC ..... *B65D 5/6608* (2013.01); *B65D 5/0254* (2013.01); *B65D 2215/04* (2013.01)

(58) Field of Classification Search
CPC ..... B65D 2215/00; B65D 2215/02; B65D 2215/04; B65D 50/046; B65D 50/048; B65D 2571/0016; B65D 5/6608
See application file for complete search history.

(56) References Cited

U.S. PATENT DOCUMENTS 3,924,800 A * 12/1975 Desmond ..... B65D 5/10 206/807
3,949,931 A * 4/1976 Hall ..... B65D 5/22 229/102

(Continued)

FOREIGN PATENT DOCUMENTS

EP 519389 A1 12/1992
EP 1700798 A1 9/2006

(Continued)

OTHER PUBLICATIONS

International Search Report and Written Opinion for International Application No. PCT/IB2016/052967, dated Jul. 7, 2016, 9 pages.

*Primary Examiner* — Brian D Nash
(74) *Attorney, Agent, or Firm* — Fish & Richardson P.C.

(57) ABSTRACT

The present invention refers to a child-proof container (1) comprising: a housing (2) made of sheet material defining an inner volume (3) and exhibiting a passage opening (5) delimited by a free edge (6), a closing system (7) made of sheet material configured for defining a closed and opened conditions of the housing (2), the closing system (7) comprises a tab (8) having a closing portion (9) movable with respect to the housing free edge. The container (1) comprises a safety device (11) made of sheet material exhibiting: a first hooking portion (12) carried by the tab (8), a second hooking portion (13) engaged with the housing (2). The first and second hooking portions (12, 13) are configured for stably engaging with each other in the closed condition of the closing system (7) and for defining a safety condition: the first and second hooking portions (12, 13), in the safety condition, are configured for preventing the closing system (7) from switching from the closed to the opened condition.

19 Claims, 15 Drawing Sheets

(56) References Cited

U.S. PATENT DOCUMENTS

| | | | | | |
|---|---|---|---|---|---|
| 4,364,488 | A * | 12/1982 | Anjou | A24F 27/00 | 206/1.5 |
| 4,401,210 | A * | 8/1983 | Anjou | B65D 11/12 | 206/1.5 |
| 5,350,108 | A * | 9/1994 | Friar | B65D 5/6608 | 229/102 |
| 6,047,829 | A * | 4/2000 | Johnstone | B65D 5/38 | 206/1.5 |
| 6,976,576 | B2 * | 12/2005 | Intini | A45C 13/18 | 206/1.5 |
| 7,389,875 | B2 * | 6/2008 | Sandberg | B65D 5/38 | 206/1.5 |
| 7,637,375 | B2 | 12/2009 | Sattel | | |
| 7,690,510 | B2 | 4/2010 | Sattel | | |
| 7,819,250 | B2 | 10/2010 | Sattel | | |
| 8,333,288 | B2 | 12/2012 | Miller | | |
| 9,783,335 | B2 * | 10/2017 | Everett | B65D 5/541 | |
| 2005/0173291 | A1 | 8/2005 | Specker | | |
| 2014/0346220 | A1 | 11/2014 | Saulas | | |
| 2015/0048113 | A1 | 2/2015 | Brannon | | |

FOREIGN PATENT DOCUMENTS

| | | | |
|---|---|---|---|
| EP | 2808265 | A1 | 12/2014 |
| WO | WO2004020312 | A1 | 3/2004 |
| WO | WO2012021586 | A1 | 2/2012 |
| WO | WO2016198978 | A1 | 12/2016 |

* cited by examiner

CHILD-PROOF CONTAINERS AND RELATED METHODS

CROSS REFERENCE TO RELATED APPLICATIONS

This patent application is a 371 U.S. National Application of PCT/IB2016/052967, filed May 20, 2016, which claims priority to Italian Patent Application No. 102015000023288, filed Jun. 12, 2015, the entire contents of which are incorporated herein by reference.

TECHNICAL FIELD

This disclosure relates to child-proof containers and processes for making the such containers. The containers can be used in several fields (e.g., the pharmaceuticals and cosmetics fields) for applications where children should be prevented from opening containers for safety reasons.

BACKGROUND

Child-proof containers (e.g., and child-resistant packaging) are generally designed to prevent children under the age of 5 years from opening the containers. Such containers are particularly advantageous for pharmaceutical applications, for which it is important to prevent very young children from ingesting potentially toxic drugs and consequently preventing accidental poisoning. Child-proof containers and packages having child-proof safety systems are further widely used for household chemicals (for example, detergents, degreasers, and sanitizers) and cosmetics.

In some embodiments, child-proof containers are made of a paper material housing having a box-type shape adapted to receive a plastic material blister pack destined to hold multiple products. Such housings may have two slits that are arranged along opposite lateral, longitudinal walls and that are arranged along a diagonal of the container. In some embodiments, the blister pack has a substantially rectangular shape and includes two projections adapted to enter respective slits in the housing. An engagement between the projections with the slits prevents the blister packs from being extracted by pulling when the blister pack is disposed within the housing. When somebody wants to extract the blister pack from the housing, it is necessary to apply a pressure on the projections in order to push them towards the inside of the housing to disengage the slits in order to extract the blister pack from the housing.

In some embodiments, child-proof containers include a housing of paperboard having a box-shape adapted to receive a plastic material blister pack and configured to block the blister pack from exiting the container. In such embodiments, the housing is also provided with a portion shaped as a pushbutton that can act on the blister pack to disengage the blister pack from the housing so that the blister pack can be extracted from the container. It is possible to extract the blister pack by pressing the push button-shaped portion and simultaneously by pulling the blister pack outside of the housing.

The containers discussed above have an opening mechanism that must be properly grasped and handled such that the containers are difficult for children under the age of 5 years to open. However, these containers have limitations and drawbacks. For example, such containers do not provide for a safe closure by a cooperation between the housing and the blister pack such that the containers cannot be used flexibly. In fact, a child-proof safety mechanism can only be effected for these containers with a housing that receives a blister pack designed specifically for the particular housing. Therefore, the blister pack must be made by specific, non-standard manufacturing methods that require specific, corresponding apparatuses suitably designed and tooled for making the containers, resulting in increases production costs and higher priced products, accordingly. Furthermore, such containers have a somewhat complex structure, which further negatively affects the associated manufacturing and product costs.

SUMMARY

Therefore, it is an object of the present invention to substantially solve at least one of the inconveniences and/or limitations of the preceding solutions.

A first object of the present invention includes providing a container which can effectively prevent children from gaining access by keeping at a same time a simple and compact structure. A further object of the present invention includes providing a child-proof container exhibiting a stable structure capable of maintaining its integrity despite many openings and closings of the container itself.

Further, it is an object of the present invention to provide a child-proof container exhibiting a highly flexible structure. An additional object of the present invention includes providing a container exhibiting a simple and cost-effective structure. A further object of the invention includes making a container which does not require to use different materials for the manufacturing thereof; for example, the container can be made of paper material, optionally, a biodegradable material.

Then, it is an object of the present invention to provide a fast and highly flexible process for making a container, which can therefore minimize the manufacturing costs. Particularly, it is an object of invention to make a container which does not require to modify the already existing plants used for making standard-type containers for adapting them to make a container object of the present invention and which moreover does not require to modify the existing packaging plants for filling the package itself.

These and other objects, which will better appear in the following description, are substantially achieved by a container and a process for making the same according to what is disclosed in one or more of the accompanying claims and/or of the following aspects, considered alone or in any combinations of them or in a combination with anyone of the attached claims and/or in combination with anyone of the further aspects or features described in the following.

Aspects of the invention will be described in the following.

In a 1st aspect it is provided a child-proof container comprising:

a housing made of sheet material defining an inner volume configured for housing at least one product, the housing exhibiting a predetermined number of lateral walls defining at least one passage opening delimited by a free edge, said passage opening being configured for communicating the inner volume of the housing with the outer environment, a closing system also made of sheet material engaged at the free edge and movable, particularly by rotation, with respect to the housing, the closing system being configured for defining at least one closed condition wherein the system itself prevents the communication between the inner volume of the housing and the outer environment, the closing system being further configured for defining an opened condition wherein the system itself enables the communication between the inner volume and the outer environment, the closing system comprising at least one tab having a closing portion engaged with the free edge of the housing and movable, particularly by rotation, with respect to this latter, the tab further exhibiting at least one inserting portion configured for being inserted, in the closed condition of the closing system, inside the inner volume of the housing, at least one safety device made of sheet material comprising:

at least one first hooking portion (12) carried by the tab (8) of the closing system (7), at least one second hooking portion (13) engaged with the housing (2) and configured for cooperating with said first hooking portion (12), the first and second hooking portions (12, 13) being configured for stably engaging with each other in the closed condition of the closing system (7), in order to define a safety condition, said first and second hooking portions (12, 13), in the safety condition, being configured for preventing the closing system (7) from switching from the closed condition to the opened one, wherein the container (1) comprises at least one slit (15) configured for enabling, at least in the safety condition, to insert at least one opening device (14) adapted to enable to disengage the first and second hooking portions (12, 13) from each other and therefore to enable the closing system (7) to switch from the closed condition to the opened one, the safety device (11) being further configured for enabling the first and second hooking portions (12, 13) to reversibly switch, following the opened condition of the closing system, to the safety condition.

In a 2nd aspect according to the aspect 1, the housing (2) is made of paper sheet material.

In a 3rd aspect according to the aspect 1 or 2, the closing system (7) is made of paper sheet material.

In a 4th aspect according to the aspect 1 or 2 or 3, the safety device (11) is made of paper sheet material.

In a 5th aspect according to anyone of the aspects from 1 to 4, the container (1) comprises an opening device (14) configured for being inserted, at least in the safety condition, at least partially through the slit (15) of the container (1) for enabling to disengage the first and second hooking portions (12, 13) from each other and for enabling the closing system (7) to switch from the closed condition to the opened one.

In a 6th aspect according to anyone of the aspects from 1 to 5, the opening device (14) is configured for being inserted, at least in the safety condition, inside the housing (2) between the first and second hooking portions (12, 13) in order to enable the disengagement.

In a 7th aspect according to anyone of the preceding aspects, the closing system (7) is configured for switching from the closed condition to the opened one only when the closing device (14) is interposed between said first and second hooking portions (12, 13).

In an 8th aspect according to anyone of the preceding aspects, the closing system (7), when switching from the closed condition to the opened one, is configured for being moved integrally with the opening device (14).

In a 9th aspect according to anyone of the preceding aspect, the first hooking portion (12) exhibits at least one undercut (16) configured for abutting, in the safety condition, against at least one respective undercut (17) of the second hooking portion (13).

In a 10th aspect according to the 9th aspect, the undercut (17) of the second hooking portion (13) comprises at least one hook (18) defining a seat (19) the concavity thereof faces a lateral wall (4) of the housing (2), particularly faces a lateral wall of the housing (2) immediately adjacent the lateral wall directly carrying said second hooking portion (13).

In an 11th aspect according to the aspect 10, the first hooking portion (12) of the safety device (11) is configured for being stably engaged inside the seat (19) of the hook (18) of the second hooking portion (13) in the system (7) closed condition.

In a 12th aspect according to the aspect 10 or 11, the undercut (16) of the first hooking portion (12) comprises at least one respective hook (20) defining a seat (20*a*), the concavity thereof, in the safety condition, faces a concavity of the seat (19) of the hook (18) of the second hooking portion (13).

In a 13th aspect according to anyone of the aspects from 9 to 12, the undercut (17) of the second hooking portion (13) carried by the housing (2) comprises a gripping edge (17*a*) distinct and spaced from the free edge (6) of the housing (2).

In a 14th aspect according to the aspect 12 or 13, the first hooking portion (12) comprises two hooks (20) placed oppositely to each other with respect to the first hooking portion (12) itself, particularly said hooks (20) exhibit respective seats (20*a*), the concavities thereof facing away from each other.

In a 15th aspect according to anyone of the preceding aspects, the slit (15) is placed at the free edge (6) of the housing (2).

In a 16th aspect according to anyone of the preceding aspects, the slit (15) of the container (1) is defined by:

at least one cutout (15*a*) carried by the closing system (7), particularly placed at the free edge (6) and inserting portion (10) of the closing system (7) itself; and/or an aperture present between the inserting portion (10) of the closing system (7) and a lateral wall of the housing (2) carrying said second hooking portion (13).

In a 17th aspect according to anyone of the preceding aspects, the slit (15) comprises at least one cutout (15*a*), particularly a plurality of cutouts (15*a*), defined at least on the inserting portion (1) of the closing system (7) at the closing portion (9) of this latter and at the free edge (6) of the housing (2).

In an 18th aspect according to the aspect 17, the slit (15) comprises two cutouts (15*a*) spaced from each other and defined at least partially on the inserting portion (10), said inserting portion (10) comprising an abutment edge (21) interposed between the two cutouts of the slit (15) which is configured for preventing the opening device (14) from completely entering the volume (3) of the housing (2).

In a 19th aspect according to anyone of the preceding aspects, the second hooking portion (13) develops substantially parallelly to a lateral wall (4) of the container (1), particularly develops parallelly to the lateral wall of the housing (2) directly facing, in the closed condition of the closing system (7), the inserting portion (10).

In a 20th aspect according to anyone of the preceding aspects, the first hooking portion (12) is directly carried by the inserting portion (10), particularly the first hooking portion (12) is placed oppositely to the closing portion (9) of the tab (8) with respect to the inserting portion (10).

In a 21st aspect according to the aspect 20, the first hooking portion (12) is joined in one piece to the inserting portion (10).

In a 22nd aspect according to anyone of the preceding aspects, the second hooking portion (13) is engaged to a lateral wall (4) of the housing (2), particularly is directly engaged to the housing (2) lateral wall directly facing, in the closed condition of the closing system (7), the inserting portion (10).

In a 23rd aspect according to anyone of the preceding aspects, the housing (2) comprises, at and in continuity with the free edge (6), a recess (23) exhibiting an open outline and defining a depression of the free edge (6) itself, the recess (23) being configured for enabling to see and grip at least part of the inserting portion (10) under the closed condition of the closing system (7).

In a 24th aspect according to the aspect 23, the recess (23) exhibits a substantially "C" open shape, the concavity thereof faces away from the inner volume (3) of the ware housing (2).

In a 25th aspect according to anyone of the preceding aspects, the closing system (7) comprises one or more abutment portions (24) engaged to the free edge (6) of the housing (2), and configured for being brought in contact, in the system (7) closed condition, with said closing portion (9).

In a 26th aspect according to anyone of the preceding aspects, the inserting portion (10) comprises a sheet element extending between a first and second surfaces (10*a*, 10*b*) respectively facing a lateral wall (4) of the housing (2) and the inner volume (3) of the housing (2).

In a 27th aspect according to the aspect 26, the first hooking portion (12) of the safety device (11) comprises a sheet element emerging in continuity with the inserting portion (10) and extending between a respective first and second surfaces (12*a*, 12*b*), the first surface (10*a*) of the inserting portion (10) extending without interruptions from the first surface (12*a*) of the first hooking portion (12), the second surface (10*b*) of the inserting portion (10) extending without interruptions from the second surface (12*b*) of the first hooking portion (12).

In a 28th aspect according to anyone of the preceding aspects, the second hooking portion (13) of the safety device (11) comprises a sheet element extending between a first and second surfaces (13*a*, 13*b*), said first surface (13*a*) of said second hooking portion (13) being directly connected to an inner surface of the housing (2).

In a 29th aspect according to the aspect 28, the second surface (10*b*) of the inserting portion (10), under the closed condition of the closing system (7), directly faces the first surface (13*a*) of the second hooking portion (13).

In a 30th aspect according to anyone of the preceding aspects, the container (1) comprises two passage openings (5) delimited by a respective free edge (6) and opposite to each other with respect to the housing (2) itself.

In a 31st aspect according to the aspect 30, the container (1) comprises, at each of said passage openings (5), a closing system (7) and a safety device (11).

In a 32nd aspect according to the aspect 31, the container (1) comprises a first and second opening devices (14) separated from each other and configured for disengaging the first and second hooking portions (12, 13) of respective closing systems (7) respectively placed at each of said passage openings (5).

In a 33rd aspect according to anyone of the preceding aspects, the container (1) comprises at least one case (25) externally engaged to the housing (2) and configured for housing receiving the opening device (14).

In a 34th aspect according to the aspect 33, the case (25) comprises at least one sheet made of paper material externally engaged to the housing (2) and configured for defining a receiving seat adapted to receive and support the opening device (14).

In a 35th aspect according to anyone of the preceding aspects, the opening device (14) comprises a sheet element exhibiting a gripping portion (30) from which at least one appendage (26) exhibiting a polygonal shape projects, particularly substantially a square or rectangular or trapezoidal shape, configured for being inserted at least partially inside the slit (15).

In a 36th aspect according to the aspect 35, the opening device (14) exhibits a substantially "C" or "H" or "A" or "V" shape.

In a 37th aspect according to the aspect 35 or 36, the opening device (14) comprises two appendages (26) and an abutment edge (27) defined between said two appendages (26) in order to define a substantially "C" shaped sheet element, said appendages (26) being configured for being inserted inside respective cutouts of the slit (15) for disengaging the first and second hooking portions (12, 13), the abutment edge (27) being configured for abutting against the abutment edge (27) of the closing system (7) for preventing the opening device (14) from completely entering the volume (3) of the housing (2).

In a 38th aspect according to anyone of the preceding aspects, the opening device (14) is made of sheet material.

In a 39th aspect according to the aspect 38, the opening device (14) is made of paper sheet material, particularly completely of paper sheet material.

In a 40th aspect according to the aspect 39, the paper sheet material of the opening device (14) exhibits a grammage comprised between 100 and 500 g/m$^2$, particularly comprised between 200 and 300 g/m$^2$.

In a 41st aspect according to anyone of the aspects from 2 to 40, the paper sheet material of the housing (2) exhibits a grammage comprised between 100 and 500 g/m$^2$, particularly comprised between 200 and 300 g/m$^2$.

In a 42nd aspect according to anyone of the aspects from 3 to 41, the paper sheet material of the closing system (7) exhibits a grammage comprised between 100 and 500 g/m$^2$, particularly comprised between 200 and 300 g/m$^2$.

In a 43rd according to anyone of the aspects from 4 to 42, the paper sheet material of the safety device (11) exhibits a grammage comprised between 100 and 500 g/m$^2$, particularly comprised between 200 and 300 g/m$^2$.

In a 44th aspect according to anyone of the preceding aspects, the container (1) is made by folding a single sheet of paper material.

In a 45th aspect according to the aspect 44, said single sheet of paper material exhibits a grammage comprised between 100 and 500 g/m$^2$, particularly comprised between 200 and 300 g/m$^2$.

In a 46th aspect according to anyone of the preceding aspects, the paper sheet material comprises an inner and/or outer coating of plastic material.

In a 47th aspect according to anyone of the preceding aspects, the second hooking portion (13) develops completely inside the volume (3) of the housing (2), particularly the second hooking portion (13) is completely received inside the volume (3) of the housing (2).

In a 48th aspect according to anyone of the preceding aspects, the inserting portion (10) of the closing system (7), under the closed condition, is placed inside the inner volume (3) of the housing (2).

In a 49th aspect according to anyone of the preceding aspects, the first hooking portion (12), under the closed condition of the closing system (7), is completely received inside the volume (3) of the housing (2).

In a 50th aspect according to the aspect 49, the first hooking portion (12), under the closed condition of the closing system (7), is spaced from the free edge (6) of the housing (2).

In a 51st aspect according to anyone of the preceding aspects, the engagement between the second hooking portion (13) and first hooking portion (12) is completely defined inside the volume (3) of the housing (2).

In a 52nd aspect according to anyone of the preceding aspects, the first and second hooking portions (12, 13) of the closing system (7) are configured for engaging with each other only inside the inner volume (3) of the housing (2).

In a 53rd aspect according to anyone of the preceding aspects, the first and second hooking portions (12, 13) are configured for stably engaging with each other in order to define the safety condition following an opened condition of the closing system.

In a 54th aspect according to anyone of the preceding aspects, the first and second hooking portions (12, 13) are configured for reversibly switching from a disengagement condition to a safety condition following each opened condition of the closing system (7).

In a 55th aspect according to anyone of the preceding aspects, the safety device (11) does not exhibit removable portions, the system is stably joined in one piece to the closing system (7).

In a 56th aspect, a process for making a container (1) according to anyone of the preceding aspects, is provided.

In a 57th aspect, a process for making a container according to anyone of the preceding aspects is provided, said process comprising at least the following steps:

providing the housing (2) made of sheet material, providing the closing system (7) made of sheet material, which is engaged at the free edge (6) of the housing (2), the closing system (7) being configured for defining the closed and opened conditions of the container (1), providing the safety device (11) made of sheet material in which the first and second hooking portions (12, 13) are formed, the step of providing the safety device (11) forming the second hooking portion (13) placed inside the housing (2), the first and second hooking portions (12, 13) being configured for being stably engaged with each other under the closed condition of the closing system (7) in order to define a safety condition, said first and second hooking portions (12, 13), under the safety condition, are configured for preventing the closing system (7) from switching from the closed condition to the opened one, making at least one slit (15) configured for enabling, at least in the safety condition, to insert at least one opening device (14) adapted to enable to disengage the first and second hooking portions (12, 13) from each other and for therefore enabling the closing system (7) to switch from the closed condition to the opened one, the safety device (11) being configured for enabling the first and second hooking portions (12, 13) to reversibly switch, following the opened condition of the closing system (7), to the safety condition.

In a 58th aspect according to the aspect 56 or 57, the housing (2) is made of paper sheet material.

In a 59th aspect according to the aspect 56 or 57 or 58, the closing system (7) is made of paper sheet material.

In a 60th aspect according to anyone of the aspects from 56 to 59, the safety device (11) is made of paper sheet material.

In a 61st aspect according to anyone of the aspects from 56 to 60, the process comprises a step of providing an opening device (14) made of sheet material configured for being inserted, at least under the safety condition, at least partially through the slit (15) of the container (1) for enabling to disengage the first and second hooking portions (12, 13) from each other and for enabling the closing system (7) to switch from the closed condition to the opened one.

In a 62nd aspect according to anyone of the aspects from 56 to 61, the step of providing the housing (2) comprises at least the following sub-steps:

providing a first sheet (51) comprising at least one first and one second portions (52, 54) interconnected by a central connecting portion (53), the first sheet (51) further comprising at least one first and one second lateral connecting portions (55, 56), the first portion (52) being interposed between the first lateral connecting portion (55) and central connecting portion (53), the second portion (54) being interposed between the central connecting portion (53) and second lateral connecting portion (56), each of said portions (52, 53, 54, 55, 56) comprising at least two opposite longitudinal edges and two opposite end edges, said portions (52, 54), central connecting portions (53) and said lateral connecting portions (55, 56) being joined along the longitudinal edges and being aligned along a single connecting direction, folding the first sheet (51) along said longitudinal edges, joining the lateral connecting portions (55, 56) in order to form the inner volume (3) of the housing (2).

In a 63rd aspect according to the aspect 62, the step of providing the closing system (7) comprises the following sub-steps:

providing at least one second sheet (57) connected to an end edge of the first portion (52), the second sheet (57) comprising a first and second portions (58, 59) joined in one piece to each other, the first portion (58) of the second sheet (57) being interposed between the first portion (52) of the first sheet (51), and the second portion (59) of the second sheet (57), folding said first and second portions (58, 59) of the second sheet (57) in order to respectively form the closing portion (9) and the inserting portion (10) of the closing system (7).

In a 64th aspect according to the aspect 63, the step of providing the safety device (11) comprises at least the following sub-steps:

providing a third sheet (60) connected to an end edge of the second portion (54), the third sheet (60) comprising a first portion and a second portion (61, 62), folding said third sheet (60), joining said third sheet (60) to said second portion (54) of the first sheet (51), folding said first portion (61) of the third sheet (60) with respect to said second portion (62) so that said first portion forms the second hooking portion (13) of the safety device (11).

In a 65th aspect according to the aspect 63 or 64, the step of providing the safety device (11) further comprises the following sub-step:

providing a fourth sheet (63) comprising at least one portion (64) joined in one piece to the second portion (59) of the second sheet (57) and configured for forming the first hooking portion (12) of the safety device (11).

In a 66th aspect according to anyone of the aspects from 62 to 65, the process further comprises at least the following steps:

providing at least one fifth sheet (65) comprising a portion (66) connected to at least one of the central connecting portion (53) and second lateral connecting portions (56), folding the portion (66) of the fifth sheet (65) in order to form an abutment portion (24).

In a 67th aspect according to anyone of the aspects from 56 to 66, the step of providing the opening device (14) comprises at least the following sub-steps:

providing at least one sixth sheet (67), shaping said sixth sheet (67) in order to define a single portion (68) comprising at least one gripping portion (30) from which at least one appendage (26) projects.

In a 68th aspect according to the aspect 67, the sixth sheet (67) is joined in one piece to the first lateral connecting portion (55) and/or to the second lateral connecting portion (56) of the first sheet.

In a 69th aspect according to anyone of the aspects from 64, to 68, joining the third sheet (60) to the second portion (54) of the first sheet (51), for forming the second hooking portion (13), comprises a sub-step of pasting the second portion (62) of the third sheet (60) to the second portion (54) of the first sheet (51).

In a 70th aspect according to anyone of the aspects from 62 to 69, joining said lateral connecting portions (55, 56) comprises a sub-step of pasting these latter.

In a 71st aspect according to anyone of the aspects from 62 to 70, the first sheet (51) is at least partially, particularly completely, made of paper material.

In a 72nd aspect according to the aspect 66, the first sheet (51) exhibits a grammage comprised between 100 and 500 g/m$^2$, particularly comprised between 300 and 400 g/m$^2$.

In a 73rd aspect according to anyone of the aspects from 63 to 72, the second sheet (57) is at least partially, particularly completely, made of paper material.

In a 74th aspect according to the aspect 73, the second sheet (57) exhibits a grammage comprised between 100 and 500 g/m$^2$, particularly comprised between 300 and 400 g/m$^2$.

In a 75th aspect according to anyone of the aspects from 64 to 74, the third sheet (60) is at least partially, particularly completely, made of paper material.

In a 76th aspect according to the aspect 75, the third sheet (60) exhibits a grammage comprised between 100 and 500 g/m$^2$, particularly comprised between 300 and 400 g/m$^2$.

In a 77th aspect according to anyone of the aspects from 65 to 76, the fourth sheet (63) is at least partially, particularly completely, made of paper material.

In a 78th aspect according to the aspect 77, the fourth sheet (63) exhibits a grammage comprised between 100 and 500 g/m$^2$, particularly comprised between 300 and 400 g/m$^2$.

In a 79th aspect according to anyone of the aspects from 66 to 78, the fifth sheet (65) is at least partially, particularly completely, made of paper material.

In an 80th aspect according to the aspect 79, the fifth sheet (65) exhibits a grammage comprised between 100 and 500 g/m$^2$, particularly comprised between 300 and 400 g/m$^2$.

In an 81st aspect according to anyone of the aspects from 67 to 80, the sixth sheet (67) is at least partially, particularly completely, made of paper material.

In an 82nd aspect according to the aspect 81, the sixth sheet (67) exhibits a grammage comprised between 100 and 500 g/m$^2$, particularly comprised between 300 and 400 g/m$^2$.

In an 83rd aspect according to anyone of the aspects from 66 to 82, the first, second, third, fourth, fifth sheets (51, 57, 60, 63, 65) are joined in one piece in order to form a single preformed sheet (50).

In an 84th aspect according to anyone of the aspects from 66 to 83, the first, second, third, fourth, fifth and sixth sheets (51, 57, 60, 63, 65, 67) are joined in one piece in order to form a single preformed sheet (50).

In an 85th aspect according to the aspect 83 or 84, the preformed sheet (50) is at least partially, particularly completely, made of paper sheet.

In an 86th aspect according to the aspect 85, the preformed sheet (50) exhibits a grammage comprised 100 and 500 g/m$^2$, particularly comprised between 300 and 400 g/m$^2$.

In an 87th aspect according to anyone of the aspects from 56 to 86, the process comprises at least one sub-step of providing a film of plastic material on at least part of an inner and/or outer surfaces of the container (1) in order to define a coating.

In an 88th aspect according to the aspect 87, the preformed sheet (50) extends between a first and second prevalent development surfaces adapted to respectively define an inner and outer surfaces of the container (1), the process comprises a step of engaging the film of plastic material on at least part of the first and/or second prevalent development surfaces of the preformed sheet (50).

In an 89th aspect according to anyone of the aspects from 62 to 88, further comprising at least the following steps:

providing a seventh and eighth sheets (71, 72) comprising respective portions (73, 74) joined to each other along a respective longitudinal edge, the seventh sheet (71) being engaged to the second lateral connecting portion (56) of the first sheet (51), the eighth sheet (72) being engaged to the portion (73) of the seventh sheet (71), folding the portions (73, 74) of the seventh and eighth sheets (71, 72) along the respective longitudinal edge, stably joining along a transversal perimetral edge the portions (73, 74) of the seventh and eighth sheets (71, 72) in order to define the case (25).

In a 90th aspect according to the aspect 89, the seventh sheet (71) is joined in one piece to the second lateral connecting portion (56) of the first sheet (51).

In a 91st aspect according to the aspect 89 or 90, the sixth sheet (67) is defined between a seventh and eighth sheets (71, 72).

In a 92nd aspect according to anyone of the aspects from 63 to 91, the step of providing the second sheet (57) comprises making at least one cutout (15*a*) in order to define said slit (15).

In a 93rd aspect according to the aspect 92, the cutout (15*a*) is made on the first and/or second portions (58, 59) of the second sheet (57).

In a 94th aspect according to the aspect 92 or 93, the cutout (15*a*) is made at a delimiting transversal edge between the first and second portions (58, 59) of the second sheet (57), the slit (15) being configured so that said opening device (14) at least partially enters through it.

BRIEF DESCRIPTION OF THE DRAWINGS

Some embodiments and some aspects of the invention will be described in the following with reference to the attached drawings, given only in an indicative and therefore non limiting way, wherein.

Figure 13:
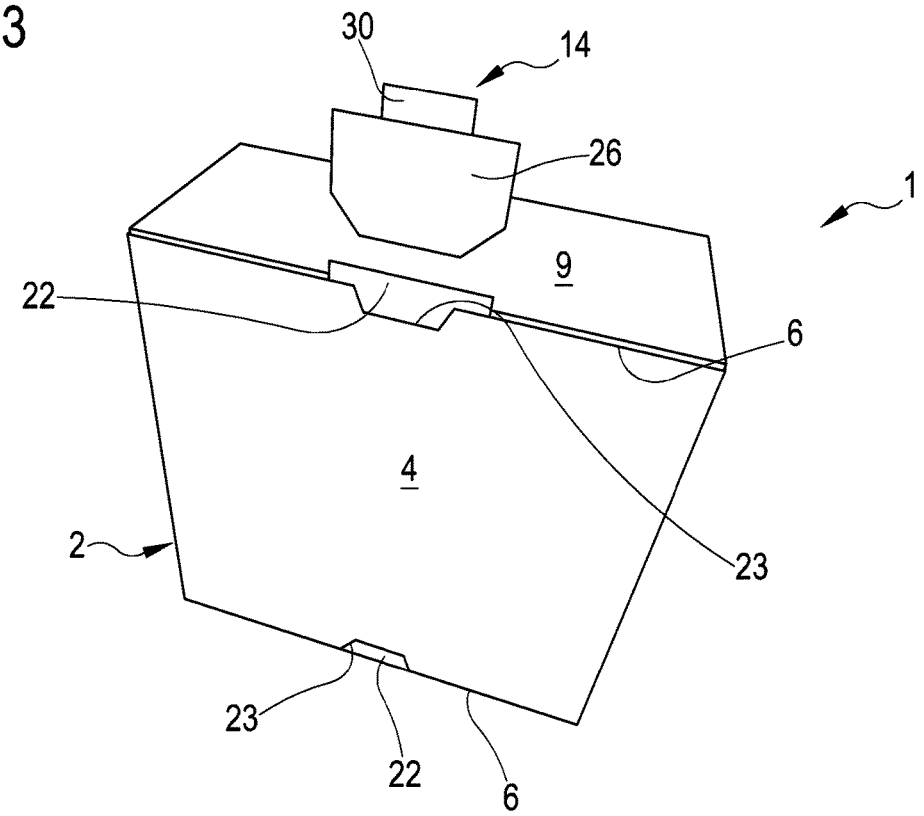
FIG. 13 is a perspective view of an embodiment variant of a container according to the present invention.
Figure 14:
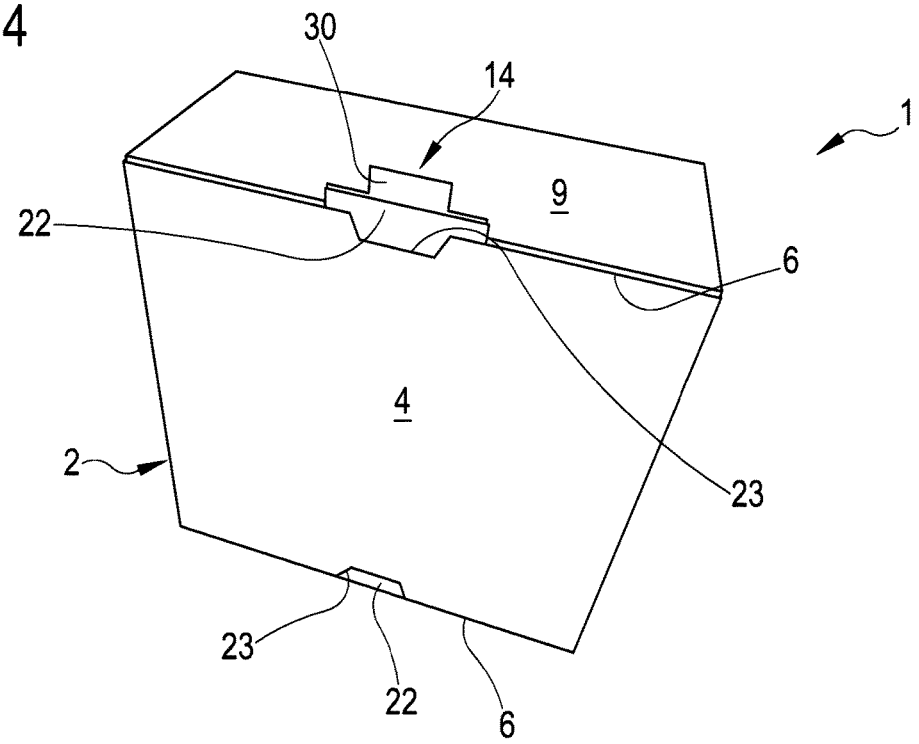
Figure 15:
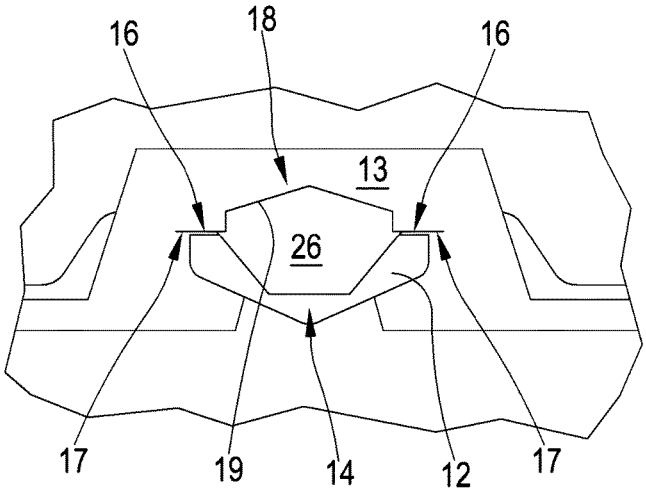
Figure 16:
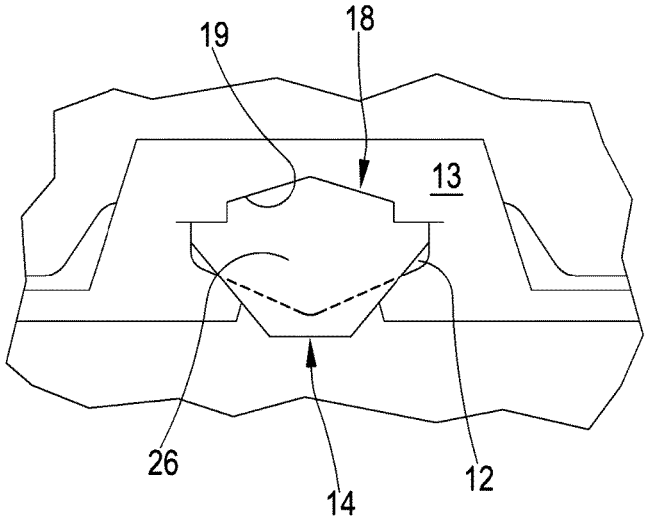
Figure 17:
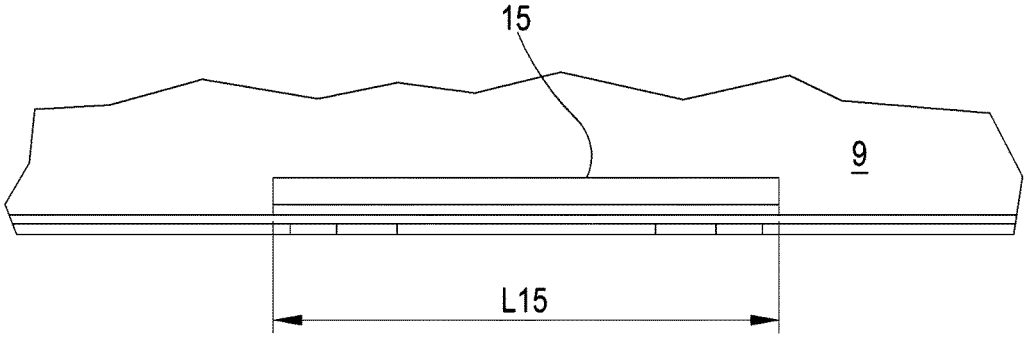
Figure 18:
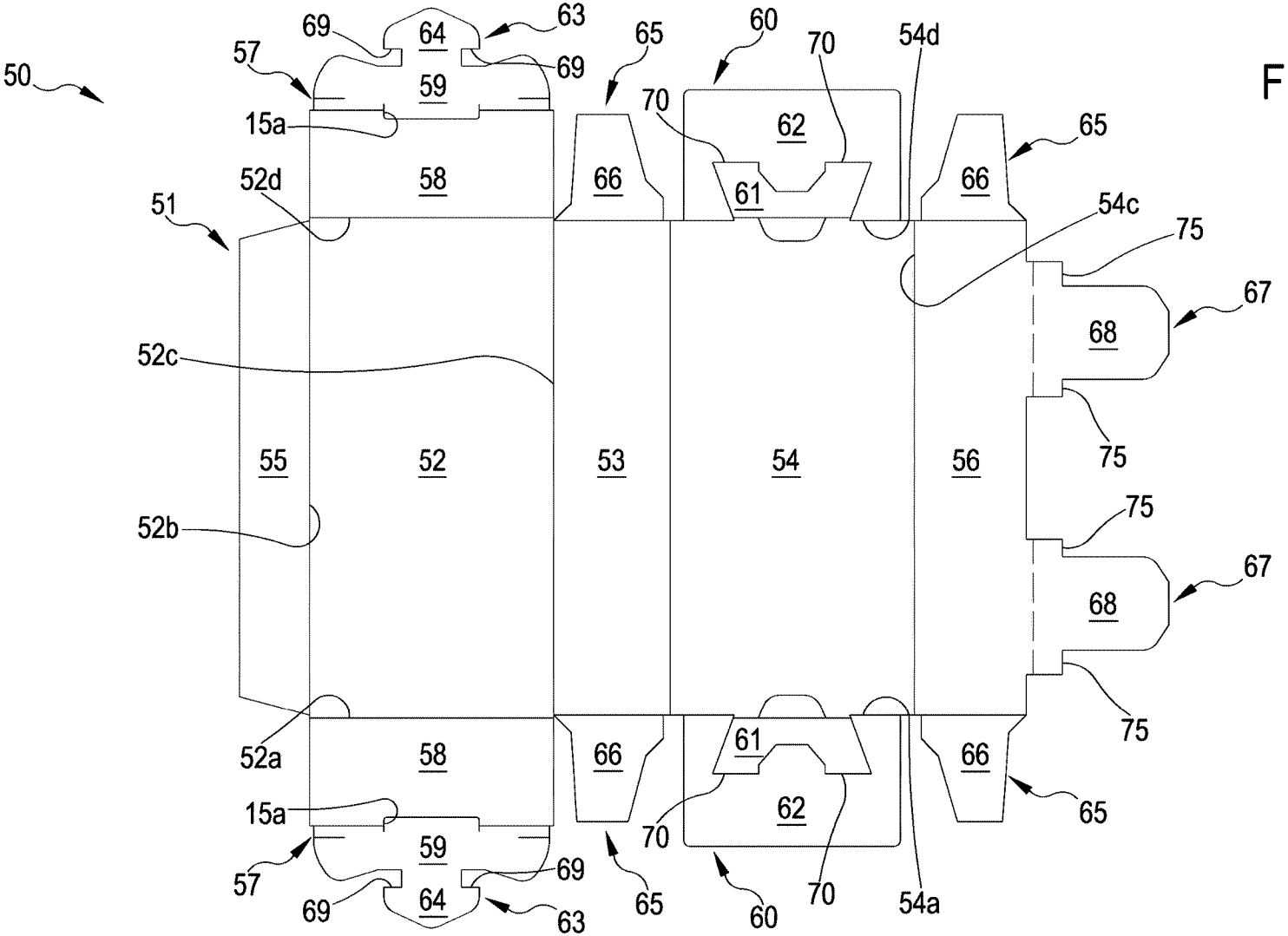
Figure 19:
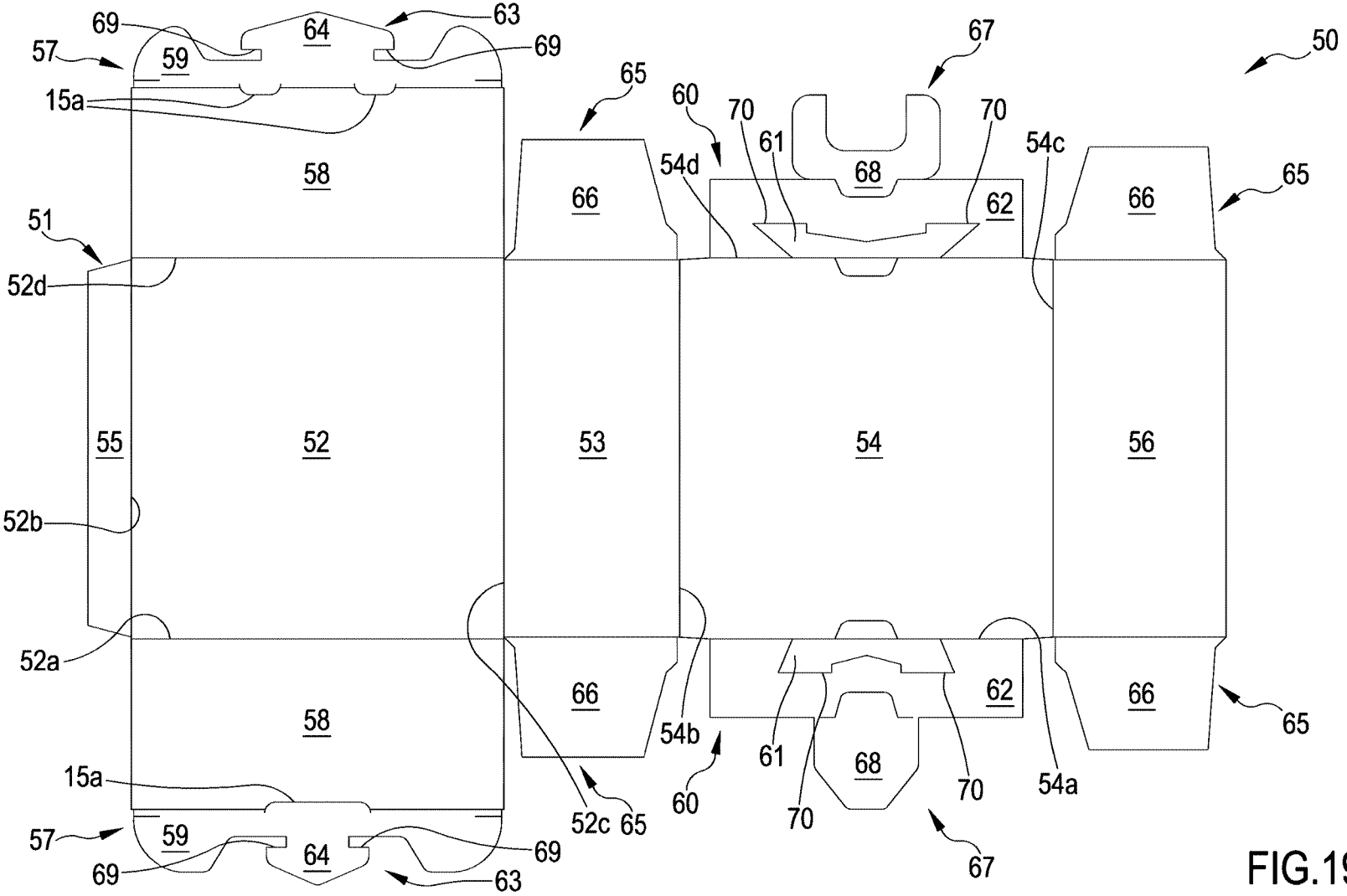
Figure 20:
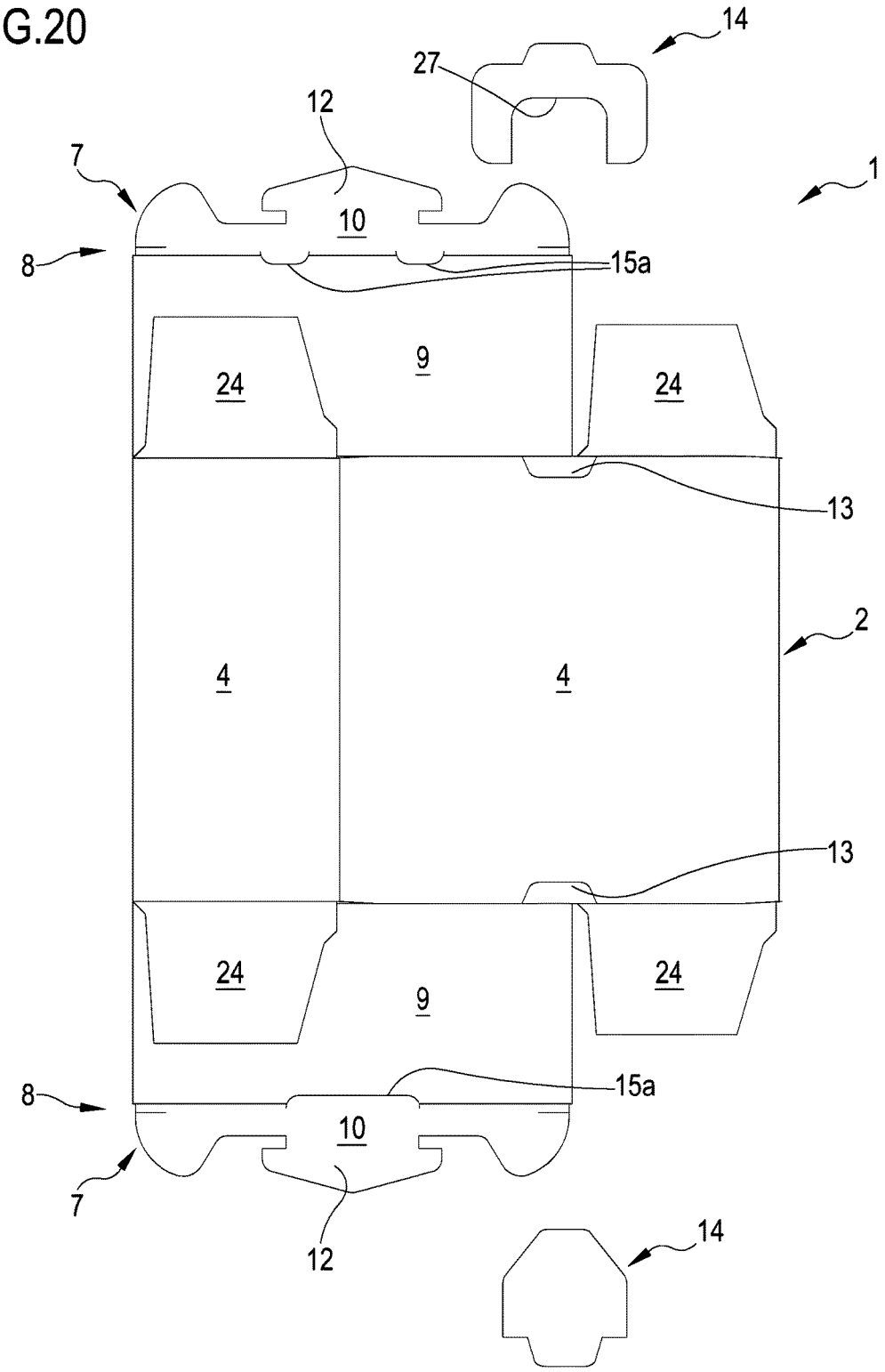
Figure 21:
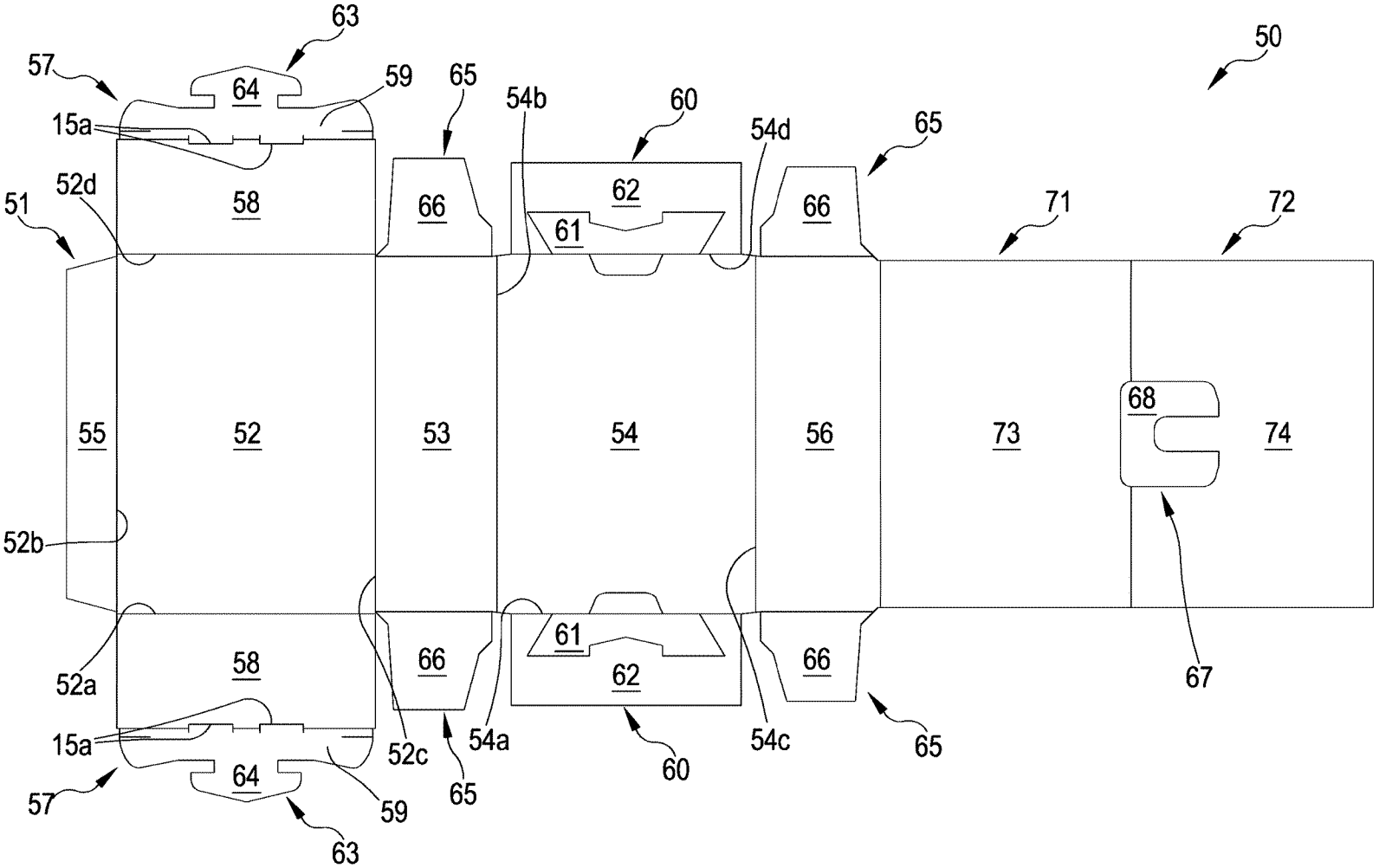
Figure 22:
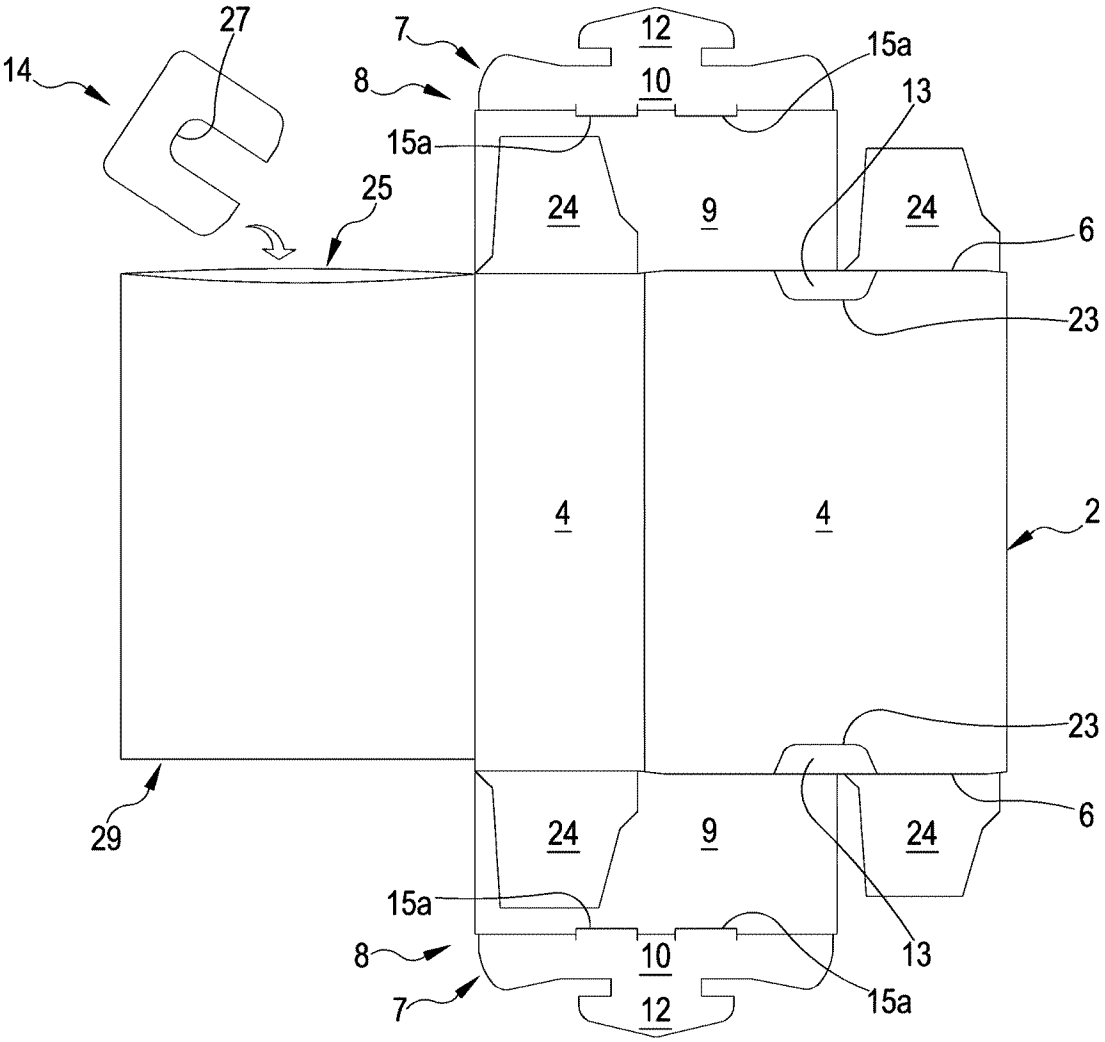

FIGS. from 14 to 16 are schematic views of the container of FIG. 13 during the opened conditions of the same;

FIG. 17 is a top detailed view of the container 1 of FIG. 13;

FIG. 18 schematically illustrates a second blank for making a container according to the present invention;

FIG. 19 schematically illustrates a third blank for making a container according to the present invention;

FIG. 20 represents a container made from the blank of FIG. 19 and placed in a stored crushed condition;

FIG. 21 schematically illustrates a fourth blank for making a container according to the present invention;

FIG. 22 represents a container made from the blank of FIG. 21 and arranged in a stored crushed condition.

DETAILED DESCRIPTION

Materials and Definitions

In some examples, the figures may illustrating an object of the invention may not be drawn to scale. In some examples, parts and components illustrated in the figures may be provided as schematic views.

Instead, the term "product" means an article or a compound of articles of any type. For example, the product can be a drug or medicament in the solid, liquid or gel state, in other words in a state of two or more of the cited aggregation states. Further, the product can mean a package, for example a blister pack, receiving a plurality of articles.

The container 1 can be at least partially made of a paper sheet material. The term paper material means paper or paperboard: specifically, the sheet material useable for making the container can exhibit a grammage comprised between 100 and 500 g/m$^2$, particularly comprised between 200 and 400 g/m$^2$. The relevant paper material extends between a first and second prevalent development surfaces. The sheet paper material used for making the container can, in an embodiment variant thereof, be covered, for at least part of the first and/or second prevalent development surfaces, by a coating of plastic material, for example a film, whose aim is to reinforce the container. When the coating is placed in order to cover an outer surface of the container, this can be further used for defining a water and/or moisture barrier useful for avoiding weakening and a loss of structural integrity of the container with the consequent deformation of the paper material making this latter component. Advantageously but not in a limiting way, the coating could comprise and extrusion coating on one or both sides (inner side and/or outer side) of the paper material defining the container, with values which can for example range between 10 and 50 μm of the coating material (in other words of polyethylene). The coating plastic material can be for example selected among the following materials: LDPE, HDPE, PP, PE.

Container

Figure 3:
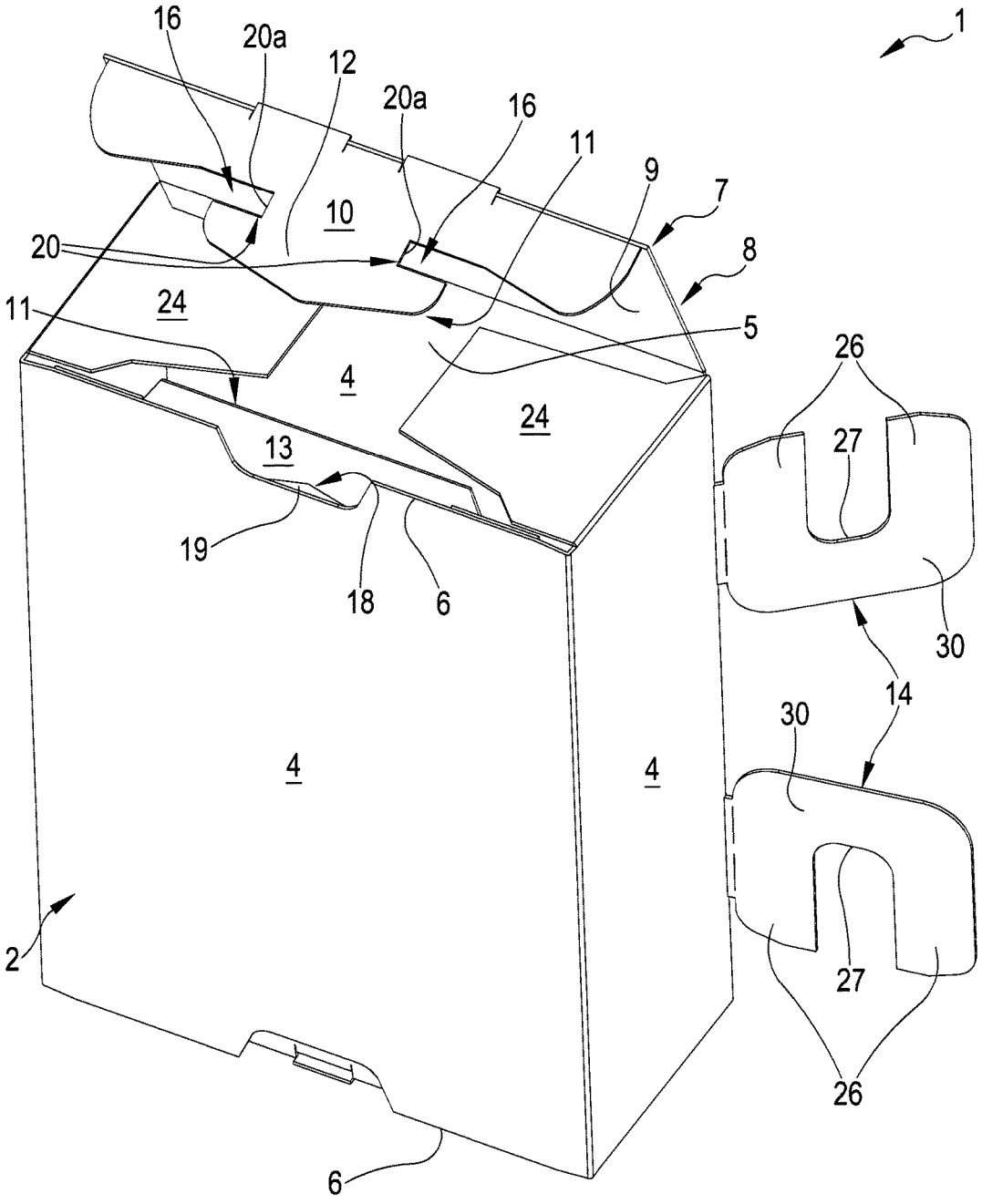
FIG. 3 illustrates a container according to the present invention in an opened condition.

Referring to FIG. 3, a child-proof container 1 includes a type of closure that can be opened under certain conditions. Such closure is designed to prevent children from opening the container 1. The container 1 can be used for various applications in different fields for which children should be prevented from opening the container 1 for safety reasons. For example, the container 1 can be advantageously used in the pharmaceuticals and cosmetics fields.

The container 1 includes a housing 2 made of sheet material defining an inner volume 3 configured for housing products, such as a blister pack. The housing 2 provides a compartment adapted to house the products. More particularly, the housing 2 includes a predetermined number of lateral walls 4 (e.g., four lateral walls 4) defining an opening 5 delimited by a free edge 6 at a first end of the container 1. The opening 5 is configured for communicating the inner volume 3 of the housing 2 with an external environment. In some embodiments, as shown in FIG. 3, the housing 2 also defines a second opening 5 disposed at an opposite, second end of the container 1, such that the two openings 5 together define an open conduit or tube laterally delimited by the lateral walls 4. In other embodiments, a container housing may be configured to define only one opening 5 or more than two openings.

The housing 2 has a rectangular, prismatic shape formed by the flat lateral walls 4. However, in some embodiments, a container housing may have a different shape, such as a square, trapezoidal, or cylindrical shape. In some embodiments, as shown in FIG. 3, the housing 2 has an elongate shape and has a thickness that is less than its length and width. The housing 2 has a minimum size (e.g., in this case, the thickness) that is greater than a maximum transverse size of each product to be contained in the housing 2. In some embodiments, the minimum size of the housing 2 is greater than 10 mm. However, in some embodiments, the thickness of the housing 2 can vary and be suitably sized based on the product and a quantity of the product to be received and supported within the housing 2. The container 1 has a small size such that the housing 2 defines an inner volume 3 that is substantially greater than 20,000 mm$^3$ (e.g., between 40,000 and 200,000 mm$^3$). However, in some embodiments, the container 1 can be configured for packaging products of a moderate size, such that the housing 2 has an inner volume 3 that is greater than 500,000 mm$^3$ (e.g., between 800,000 and 1,400,000 mm$^3$). In other embodiments, the container 1 can be configured for packaging products of large size, such that the housing 2 has an inner volume 3 that is greater than the above-cited volumes (e.g., greater than 10,000 cm$^3$).

The housing 2 can be made (e.g., folded) from a paper sheet material. However, in some embodiments, the housing 2 (e.g., or the whole container 1) can be made at least partially of a plastic sheet material or a metal sheet.

Figure 11:
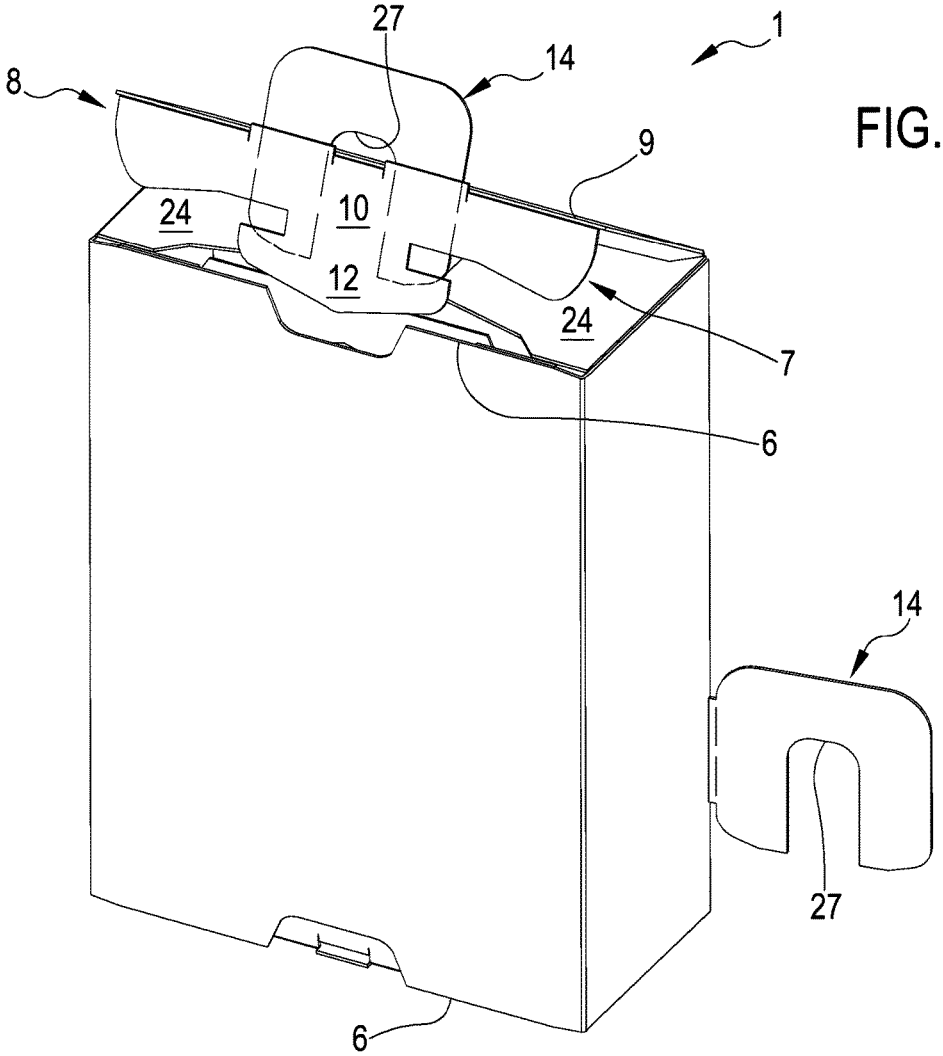
FIG. 11 is a perspective view of a container according to the present invention arranged in an opened condition.

The container 1 further includes a closure 7 that is also made of sheet material. The closure 7 is engageable with the free edge 6 at the first end of the container 1 and is movable (e.g., rotatable) with respect to the housing 2. In some embodiments, as shown in FIG. 3, the container 1 includes a second closure 7 disposed at the second end of the container 1. The closure 7 is configured for defining at least one closed configuration of the container 1 (see FIG. 7) in which the closure 7 prevents communication between the inner volume 3 of the housing 2 and the external environment. The closure 7 is further configured for defining at least one open configuration (see FIG. 11) in which the closure 7 enables communication between the inner volume 3 and external environment. The closed configuration substantially defines a safety configuration of the container 1. In the safety configuration, the container 1 cannot be opened. The closure 7 provides a lid adapted to cooperate with the housing 2 in order to control access to the inner volume 3. Advantageously, the container 1 includes a closure 7 for each opening 5 of the housing 2. Each closure 7 is joined along its length to the housing 2 and is movable (e.g., rotatable) with respect to the free edge 6 between the closed and opened configurations.

The closure 7 includes a tab 8 that has a closing portion 9. The closing portion 9 is joined along its length to the housing 2. The closing portion 9 prevents the passage of products through the opening 5 when the closure 7 is in the closed configuration. The closing portion 9 is formed as a flat body made of sheet material that is formed complimentary to the free edge 6 of the opening 5. For example, in the embodiment of FIG. 3, the closing portion 9 has a rectangular shape that is formed complimentary to the straight free edge 6.

Furthermore, the tab 8 includes an inserting portion 10 configured for being inserted inside of the volume 3 of the housing 2 to effect the closed configuration of the container 1. The inserting portion 10 extends from the closing portion 9 toward the housing 2. The inserting portion 10 is adapted to be inserted inside of the housing 2 to effect the closed configuration of the container 1. The inserting portion 10 is positioned completely inside of the volume 3 of the housing 2 when the container 1 is closed. The inserting portion 10 is formed as a flat body made of sheet material. In the embodiment of FIG. 3, the inserting portion has a rectangular shape. As shown in the cross-sectional view of FIG. 5, the inserting portion 10 has a wall with a thickness that is defined by opposite first and second surfaces 10*a*, 10*b* respectively facing a lateral wall 4 of the housing 2 and the inner volume 3 of the housing 2. In the closed configuration of the closure 7, at least one portion of the first surface 10*a* faces and directly contacts a part of the front lateral wall 4 of the housing 2. The surface 10*a* extends at least partially parallel to the front lateral wall 4 of the housing 2, opposite to the rear lateral wall 4 that is directly connected to the closure 7.

Figure 7:
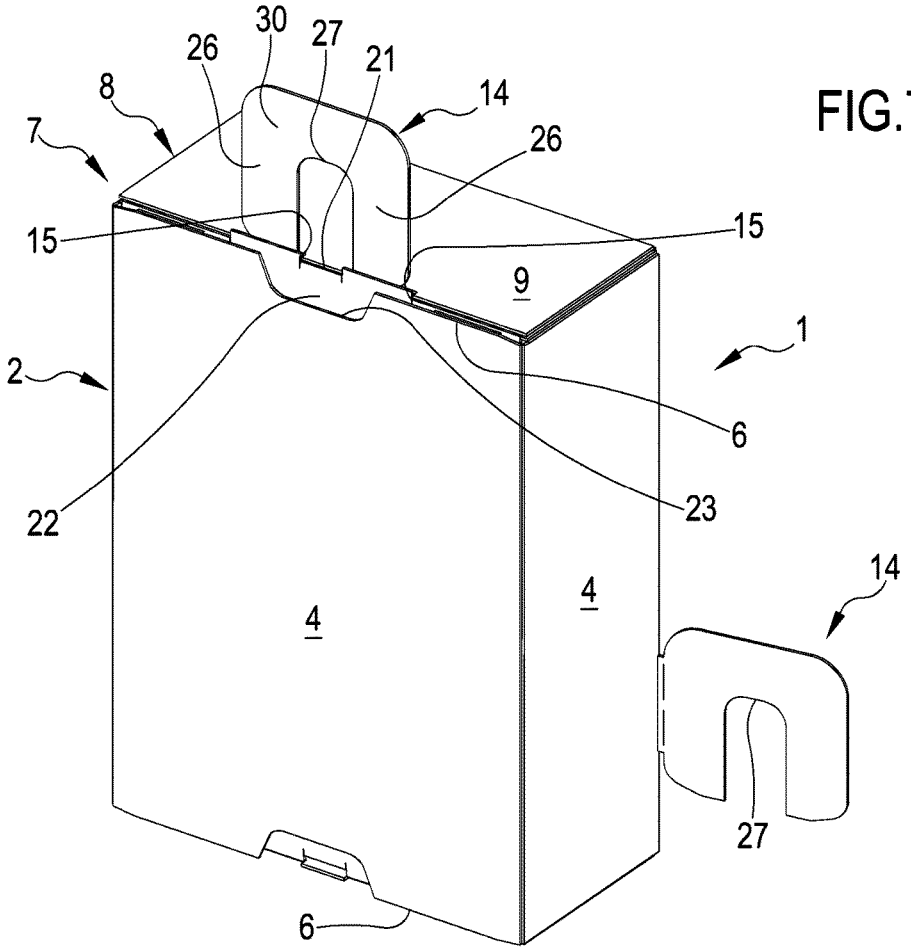
FIG. 7 is a perspective view of a container according to the present invention, arranged in the closed condition.

Referring to FIG. 7, the inserting portion 10 includes an actuating portion 22 configured to be actuated for opening the container 1, as will be described in more detail below. The free edge 6 defines a recess 23 that has a concavity having a substantially "C" shape. In some embodiments, the concavity may have a different shape. The recess 23 is configured for enabling visibility of and gripping of at least a part of the inserting portion 10 when the container 1 is closed. Particularly, in the closed configuration of the closure 7, the concavity of the recess 23 exposes the actuating portion 22 of the inserting portion 10 so that the actuating portion 22 is accessible to be moved from the outside of the container 1.

The inserting portion 10 is rotatable with respect to the closing portion 9 about an interconnecting edge disposed opposite the free edge 6 of the housing 2. The inserting portion 10 and the closing portion 9 together form a substantially "L" shape. In the closed configuration, the inserting portion 10 extends substantially parallel to a lateral wall 4 of the housing 2. Furthermore, referring to FIGS. 4, 7, and 8, the closure 7 defines two slits 15 enabling the communication between the inner volume 3 of the housing 2 and the external environment. The slits 15 can be defined at the inserting portion 10, at the closing portion 9, or along a folding line between the inserting portion 10 and the closing portion 9. In the closed configuration of the closure 7, the slits 15 are positioned at the free edge 6 of the housing 2. An intermediate edge 21 is interposed between the two slits 15. The intermediate edge 21 is configured to cooperate with an opening device 14, as will be discussed in more detail below.

Figure 12:
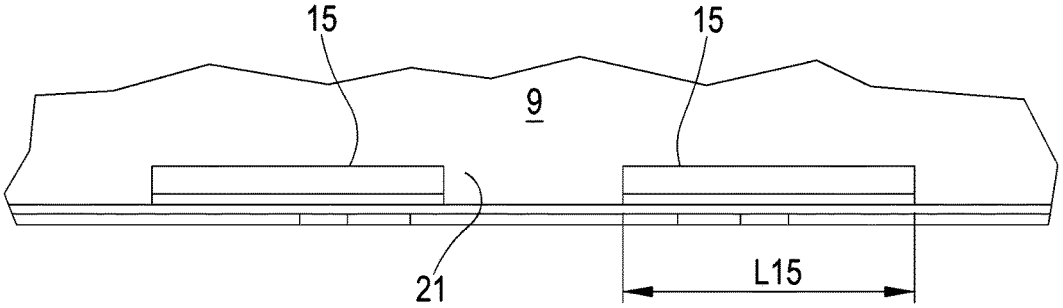
FIG. 12 is a top detailed view of the container object of the present invention.

The slits 15 can have the same dimensions or different dimensions. A set of slits 15 can be provided at respective inserting portions 10 of each closure 7. According to the embodiment illustrated in FIG. 20, the first end of the container 1 includes two slits 15 along a respective closing portion 9 and inserting portion 10, while the second, opposite end of the container 1 includes one slit 15 along a respective inserting portion 10 and closing portion 9. Referring to FIGS. 12 and 17, each slit 15 has a width L15 of between 1 and 200 mm (e.g., between 5 and 50 mm).

In the container 1 shown in FIGS. 20-22, each slit 15 includes a cutout 15*a* that is carried by the closure 7, defined at the inserting portion 10 of the closure 7, and positioned at the free edge 6 in the closed configuration. By folding the inserting portion 10 with respect to the closing portion 9, the cutout 15*a* enables rotatable movement of a flap of the closing portion 9 defined by the cutout 15*a* to open a space or aperture that forms the slit 15. The cutout 15*a* has a substantially "U" shape (see FIGS. 1 and 18-21), and the slit 15 obtained therefrom has a substantially rectangular shape (see FIGS. 12 and 17). Alternatively, the cutout 15*a* can be formed by an aperture defined between the inserting portion 10 of the closure 7 and a lateral wall 4 of the housing 2.

As shown in the figures, the closure 7 further includes at least one abutment portion 24 positioned along the free edge 6 of the housing 2 adjacent the tab 8. In the closed configuration, the abutment portion 24 is configured for being interposed between the inner volume 3 and the tab 8 in order to cooperate to stably hold the tab 8 in the closed configuration. The abutment portion 24 substantially includes a flat tab made of sheet material joined in one piece to the housing 2 adjacent the closing portion 9. In some embodiments, the abutment portion 24 has a rectangular or trapezoidal shape. In other embodiments, an abutment portion has a different shape. The abutment portion 24 is also configured to rotate with respect to the free edge 6 to face the inner volume 3 of the housing 2 in the closed configuration. The abutment portion 24 is constrained to the free edge 6 so that the abutment portion 24 can engage at least part of the inserting portion 10 and/or at least part of the closing portion 9 for stably holding the tab 8 in the closed configuration. Advantageously, the container 1 includes two abutment portions 24 opposite each other with respect to the tab 8, which is interposed between the two abutment portions 24 (see FIGS. 11, 20, and 22). In such a configuration, the two abutment portions 24 symmetrically act on the tab 8 for stably holding the tab 8 in the closed configuration. Advantageously, the closure 7 is made of a folded paper sheet material. In some embodiments, the closure 7 is integrally made with the housing 2 and with the same paper material sheet.

Figure 5:
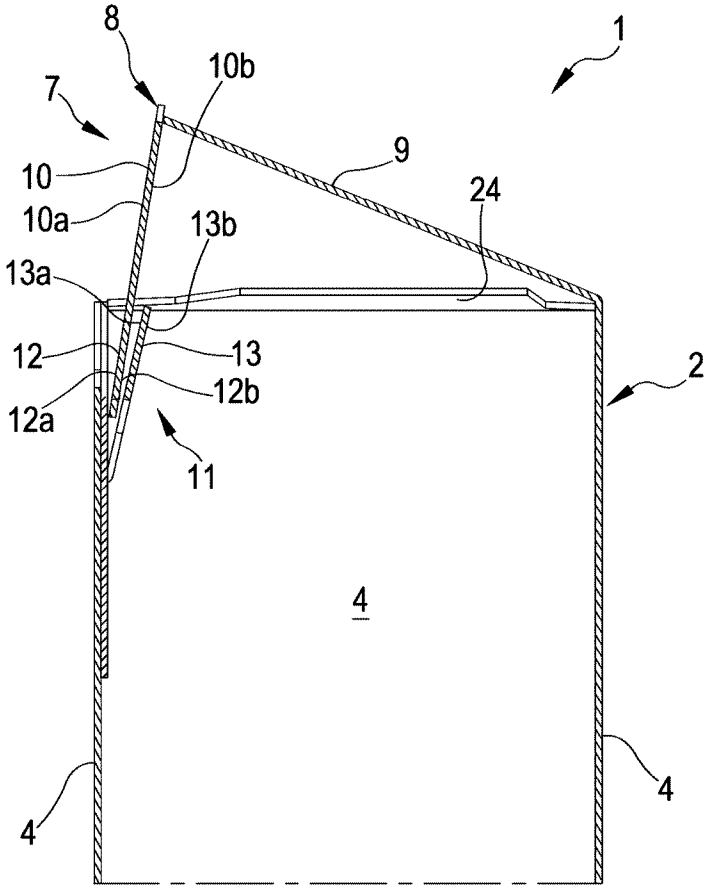
FIG. 5 is a cross-section view of the container of FIG. 4.
Figure 4:
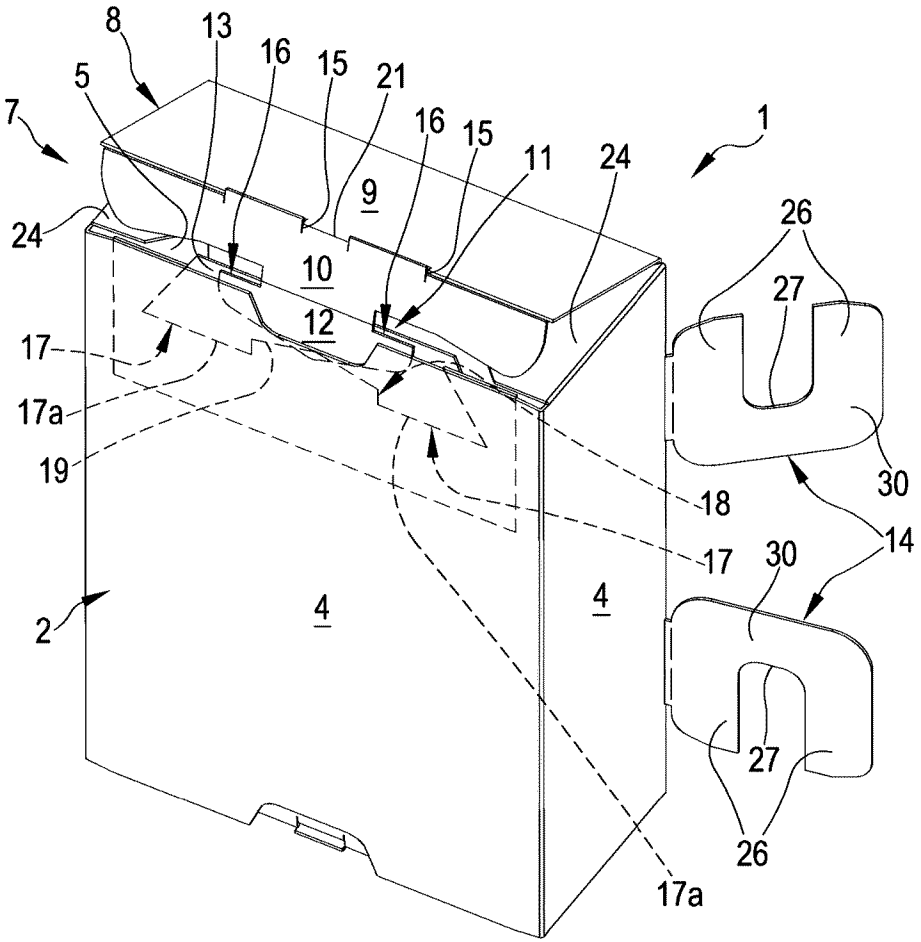
FIG. 4 illustrates a container according to the present invention during a closed condition of the same.

As shown in FIGS. 3-5, the container 1 further includes at least one safety device 11 that is made of sheet material and that includes at least one first hooking portion 12 carried by the tab 8 and at least one second hooking portion 13 engaged with the housing 2. The first and second hooking portions 12, 13 are configured for stably engaging each other in a closed configuration of the closure 7. In the closed configuration, the container 1 is substantially in a safety configuration in which the engagement between the first and second hooking portions 12, 13 prevents the container 1 from being opened. As shown in the attached figures, the second hooking portion 13 is disposed inside of the housing 2 and substantially lies parallel to one of the lateral walls 4. The second hooking portion 13 is positioned completely inside of the inner volume 3 of the housing 2 both in the closed configuration and in the open configuration of the closure 7. The first hooking portion 12 is configured to be partially or completely inserted inside of the inner volume 3 of the housing 2 in order to stably engage the second hooking portion 13 in the closed configuration. In the closed configuration, the first hooking portion 12 is completely received inside of the volume 3 of the housing 2 and is spaced from the free edge 6 of the housing 2. Moreover, in the closed configuration, the engagement between the second hooking portion 13 and first hooking portion 12 is positioned completely inside of the volume 3 of the housing 2.

The engagement between the first and second hooking portions 12, 13 is reversible. In other words, once the container 1 is opened, the first and second hooking portions 12, 13 can be reversibly reengaged in order to again effect the closed configuration, and therefore, another safety configuration, of the container 1. This is possible because the first hooking portion 12 can simply be disengaged from the second hooking portion 13. When the container 1 is opened, the second hooking portion 13 is not removed or separated from the housing 2; rather, the second hooking portion remains engaged with a lateral wall 4 of the housing 2 inside of the inner volume 3. In this way, the first and second hooking portions 12, 13 are configured for defining a safety configuration in which the first and second hooking portions 12, 13 are stably engaged with each other each time the container 1 is closed.

The first hooking portion 12 can be engaged with (e.g., directly carried by) the tab 8 of the closure 7. Advantageously, the first hooking portion 12 is carried by the inserting portion 10 of the tab 8. The hooking portion 12 and the inserting portion 10 are advantageously, integrally joined to form a unitary body. The first hooking portion 12 is formed as a flat sheet body that extends from the inserting portion 10 away from the closing portion 9. The inserting portion 10 is therefore interposed between the closing portion 9 and first hooking portion 12. The first hooking portion 12 is also configured for being inserted into the inner volume 3 during closure of the container 1.

The first hooking portion 12 has a wall thickness defined by first and second surfaces 12*a*, 12*b* (refer to FIG. 5) that respectively face in the same directions as do the first and second surfaces 10*a*, 10*b* of the inserting portion 10. The first surfaces 10*a*, 12*a* directly face a same front lateral wall 4 of the housing 2, opposite the rear lateral wall 4 directly connected to the closure 7. The second surfaces 10*b*, 12*b* face the inner volume 3 of the housing 2. The first hooking portion 12 has at least one undercut 16 configured for stably engaging the second hooking portion 13 placed inside of the housing 2 in the closed configuration of the container 1. In the closed configuration, the undercut 16 is spaced from the free edge 6 of the housing 2. As illustrated in FIG. 3, the undercut 16 defines at least one hook 20 having a concave seat 20*a*. For example, the first hooking portion 12 includes two hooks 20 having respective concave seats 20*a* that face away from each other.

The second hooking portion 13 engages a lateral wall 4 of the housing 2 and faces the inserting portion 10 in the closed configuration. The second hooking portion 13 has a wall thickness defined by first and a second surfaces 13*a*, 13*b* (see FIG. 5). The first surface 13*a* is directly connected to an inner surface of the housing 2 and faces the second surface 10*b* of the inserting portion 10 in the closed configuration of the container 1.

Figure 6:
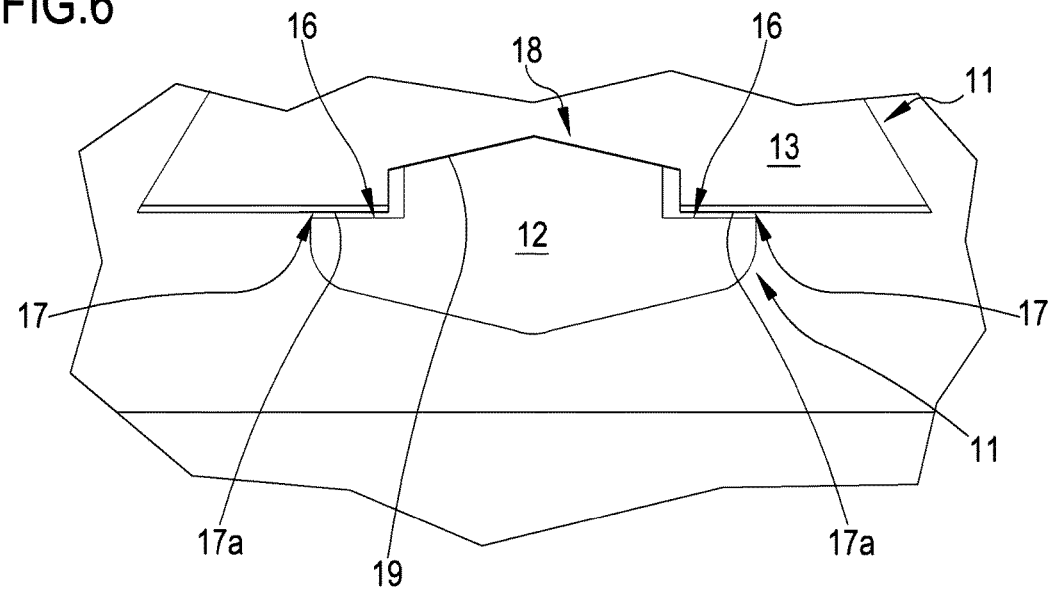
FIG. 6 is a detailed perspective view of a cut-away of the container according to the present invention arranged in a closed condition.
Figure 8:
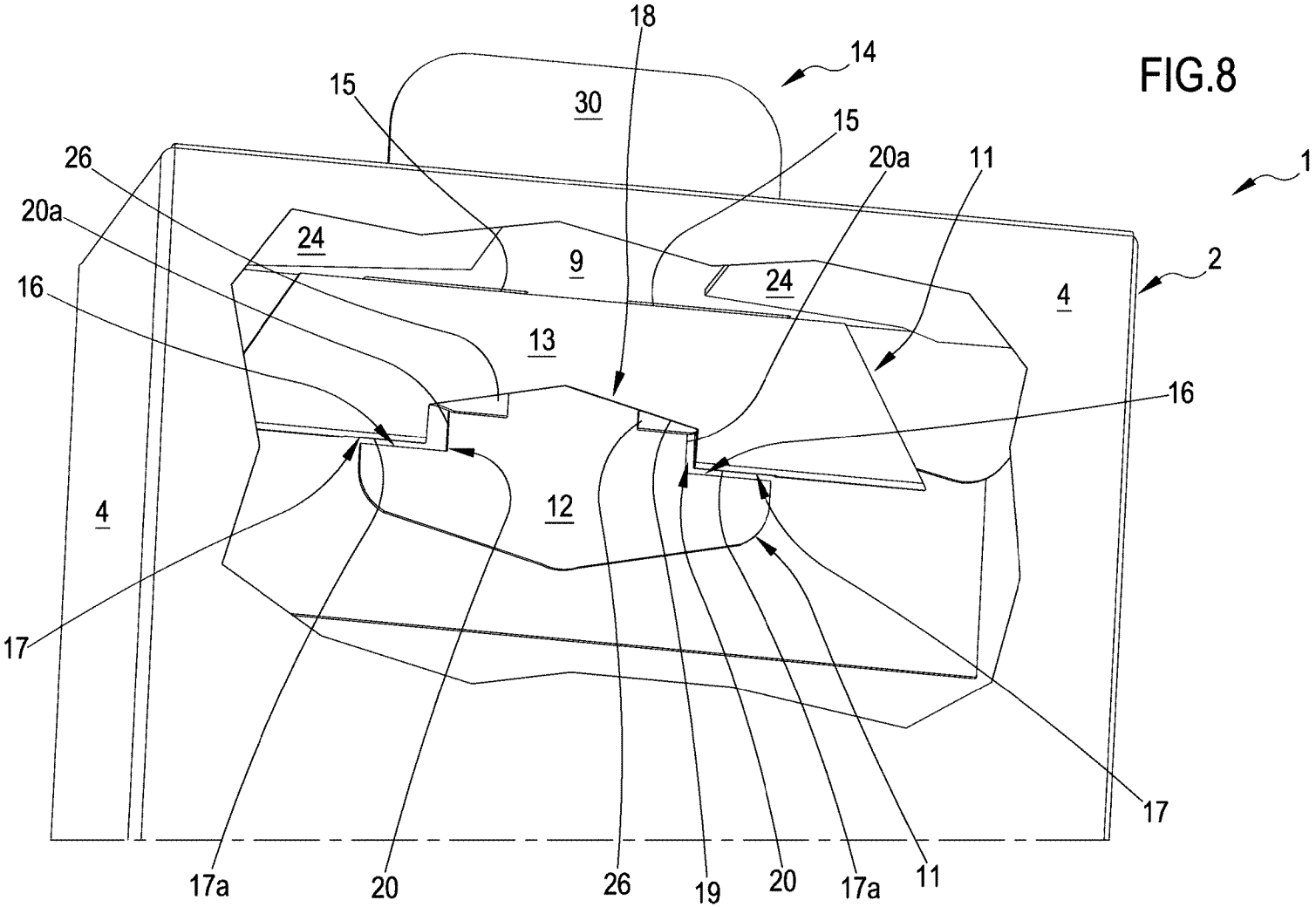
FIG. 8 is a detailed view of a cut-away of the container object of the present invention during an opened condition of the same.

Referring to FIGS. 4 and 8, the second hooking portion 13 has at least one undercut 17, which is located inside of the housing 2 and is configured for engaging the undercut 16 of the first hooking portion 12 in the closed configuration of the container 1. The undercut 17 has a gripping edge 17*a* that is distinct and spaced from the free edge 6 of the housing 2. The undercut 17 has at least one hook 18, which defines a seat 19 (see FIGS. 4 and 8). The seat 19 has a substantially "C" shape. Furthermore, the seat 19 has a concavity facing a lateral wall 4 of the housing 2 and is configured for receiving, engaging, and retaining the first hooking portion 12. In other words, the first hooking portion 12 is engaged with an inside the seat 19, and the undercuts 16, 17 are engaged with each other in the closed configuration (e.g., the safety configuration) of the container 1 (see FIG. 6). In this configuration, the concavity of the seat 19 of the hook 18 in the second hooking portion 13 faces the concavity 20*a* of the hook 20.

The container 1 is provided with an opening device 14 (e.g., a key) for opening the container 1. The opening device 14 is configured for enabling the closure 7 to be switched from the closed configuration of the container 1 to the open configuration. The opening device 14 has a gripping portion 30 from which one or more appendages 26 project. The appendages 26 can have a polygonal shape, such as a substantially square, rectangular, or trapezoidal shape. In the closed configuration of the container 1, the appendages 26 are configured and sized for being inserted inside of the slits 15 in order to contact the first and second hooking portions 12, 13 for disengaging the first and second hooking portions 12, 13.

In some embodiments, the opening device 14 may include more than two appendages 26 or additionally or alternatively include projections or valleys that may function in a different way to engage the first and second hooking portions 12, 13. For example, such appendages, projections, or valleys can help control a position of the opening device 14 as it enters the slits 15. Moreover, a shape of the opening device 14 can be configured for preventing other differently shaped devices from being used as substitute for the opening device 14.

Referring to FIGS. 13-17, in some embodiments, the opening device 14 has a single appendage 26. Such an opening device 14 can be used for opening a container 1 with a closure 7 that has a single slit 15. Referring to FIGS. 3, 4, and 7, in alternative embodiments, the opening device 14 has at least two appendages 26 projecting from the gripping portion 30. The appendages 26 extend away from an abutment edge 27 defined between them. According to this embodiment, the opening device 14 has a substantially "C" shape, "H" shape, or "A" shape. When the opening device 14 is inserted inside the slits 15, the abutment edge 27 of the opening device 14 abuts the abutment edge 21 of the closure 7 in order to limit advancement of the opening device 14 inside of the slits 15, and therefore preventing the opening device 14 from completely entering the volume 3 of the housing 2. Placement of the opening device 14 completely inside the volume 3 of the housing 2 would make it difficult to open the container 1 because the opening device 14 would not be accessible to the user. The opening device 14 is made of sheet material, such as paper sheet material (e.g., paper or paperboard). In some embodiments, the housing 2, the closure 7, and the opening device 14 is made of the same sheet of material. In some embodiments, the opening device 14 can be made of the same material as the housing 2 or the container 1. Referring to FIGS. 1, 18, 19, and 21, in some embodiments, the opening device 14 is integral the container 1 and is provided as a portion of the container 1 that is configured to be torn or separated from the container 1 when the container 1 is opened for the first time.

Referring to FIG. 20, in embodiments of the container 1 that include two openings 5 and respective closures 7 and safety devices 11, the container 1 may include first and second opening devices 14. Such opening devices 14 are configured for disengaging the first and second hooking portions 12, 13 of the respective closures 7.

Referring to FIG. 22, in some embodiments, the container 1 includes a case 25 provided with a housing seat adapted to receive and support the opening device 14 (e.g., while the opening device 14 is not in use). The case 25 is connected to the housing 2 outside of the inner volume 3. In some embodiments, the case 25 is made of a paper sheet material.

Still referring to FIG. 22, the container 1 further includes a covering portion 29. The covering portion 29 is engaged to an edge of the housing 2 and is disposed outside of the inner volume 3 of the housing 2. The covering portion 29 can rotate with respect to said edge of the housing 2 between a closed position (e.g., where the covering portion 29 abuts on an outer surface of a wall 4 of the housing 2) and an open position, as shown in FIG. 22. The covering portion 29 substantially defines the case 25 for the opening device 14.

Process for Making a Container

Figure 1:
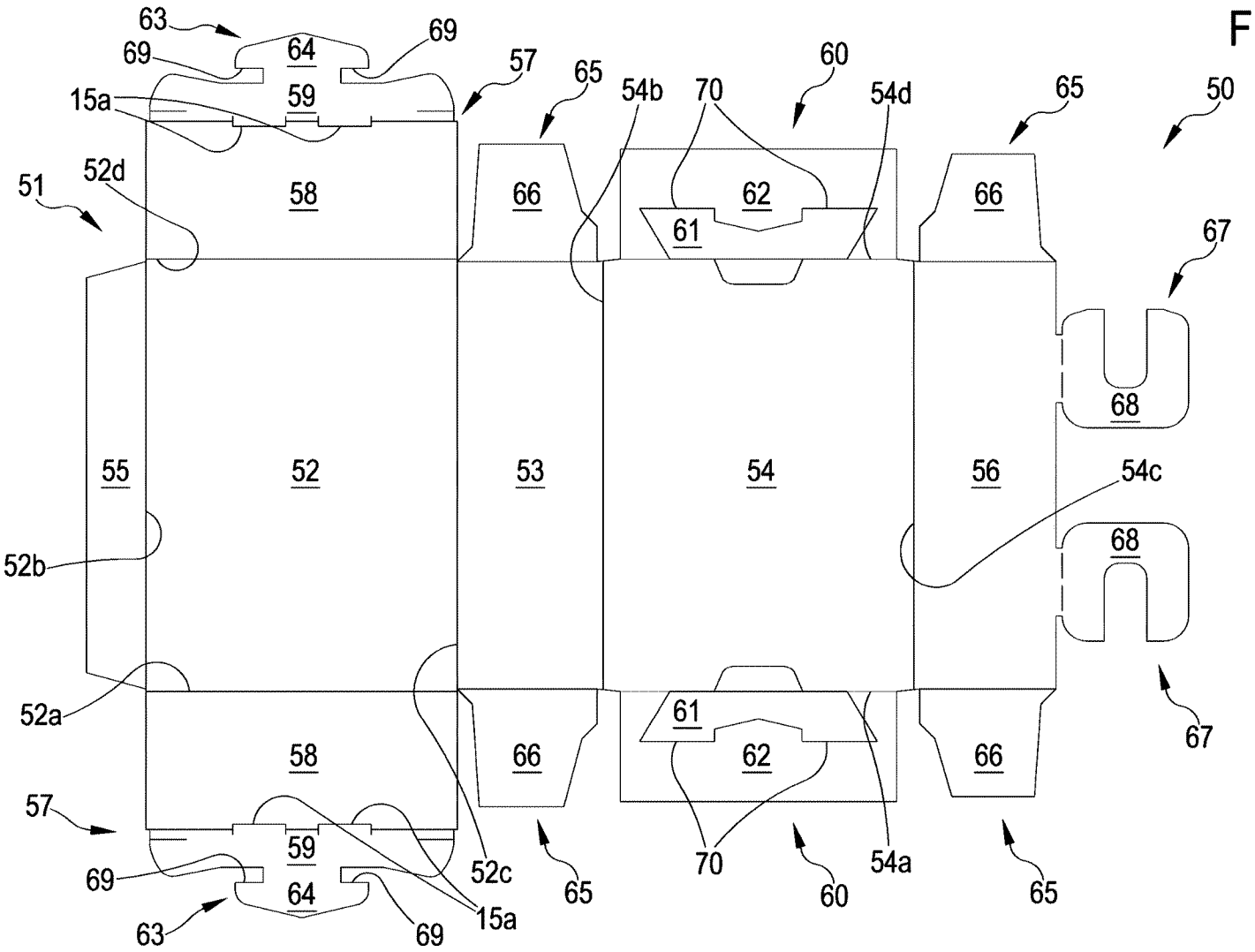
FIG. 1 schematically shows a first blank for making a container according to the present invention.

Referring to FIG. 1, the container 1 can be made from a single preformed sheet preferably of paper material. A preformed sheet 50 extends between first and second surfaces adapted to respectively define inner and outer surfaces of the container 1. In some embodiments, a process of making the container 1 includes applying a film of plastic material on at least part of the first and/or second surfaces of the preformed sheet 50.

The process further includes providing the housing 2, which is made of sheet material, such as paper. Providing the housing 2 includes providing at least one first sheet 51 including at least one first portion 52 and at least one second portion 54 interconnected by a central connecting portion 53. Referring to FIGS. 1, 2, 18, 19 and 21, the first sheet 51 includes at least one first lateral connecting portion 55 and at least one second lateral connecting portion 56. The first portion 52 is interposed between the first lateral connecting portion 55 and the central connecting portion 53, while the second portion 54 is interposed between the second lateral connecting portion 56 and the central connecting portion 53. Each portion 52, 53, 54, 55, 56 includes at least two opposite longitudinal edges and two opposite end edges. The portions 52, 54, the central connecting portion 53, and the lateral connecting portions 55, 56 are joined along the longitudinal edges and are aligned along the end edges.

In some embodiments, the first portion 52 of the first sheet 51 has a rectangular shape defined along its perimeter by a lower edge 52*a*, first and second lateral edges 52*b*, 52*c*, and an upper edge 52*d*. In the same way, the second portion 54 of the first sheet 51 has a rectangular shape defined along its perimeter by a lower edge 54*a*, first and second lateral edges 54*b*, 54*c*, and an upper edge 54*d*. Advantageously, the sheets forming the first and second portions 52, 54 having substantially the same shape and size. The central portion 53 and the lateral connecting portions 55, 56 also have a rectangular shape, are substantially the same shape and/or size, and are joined to the portions 52, 54 of the first sheet 51 at the lateral edges.

Figure 2:
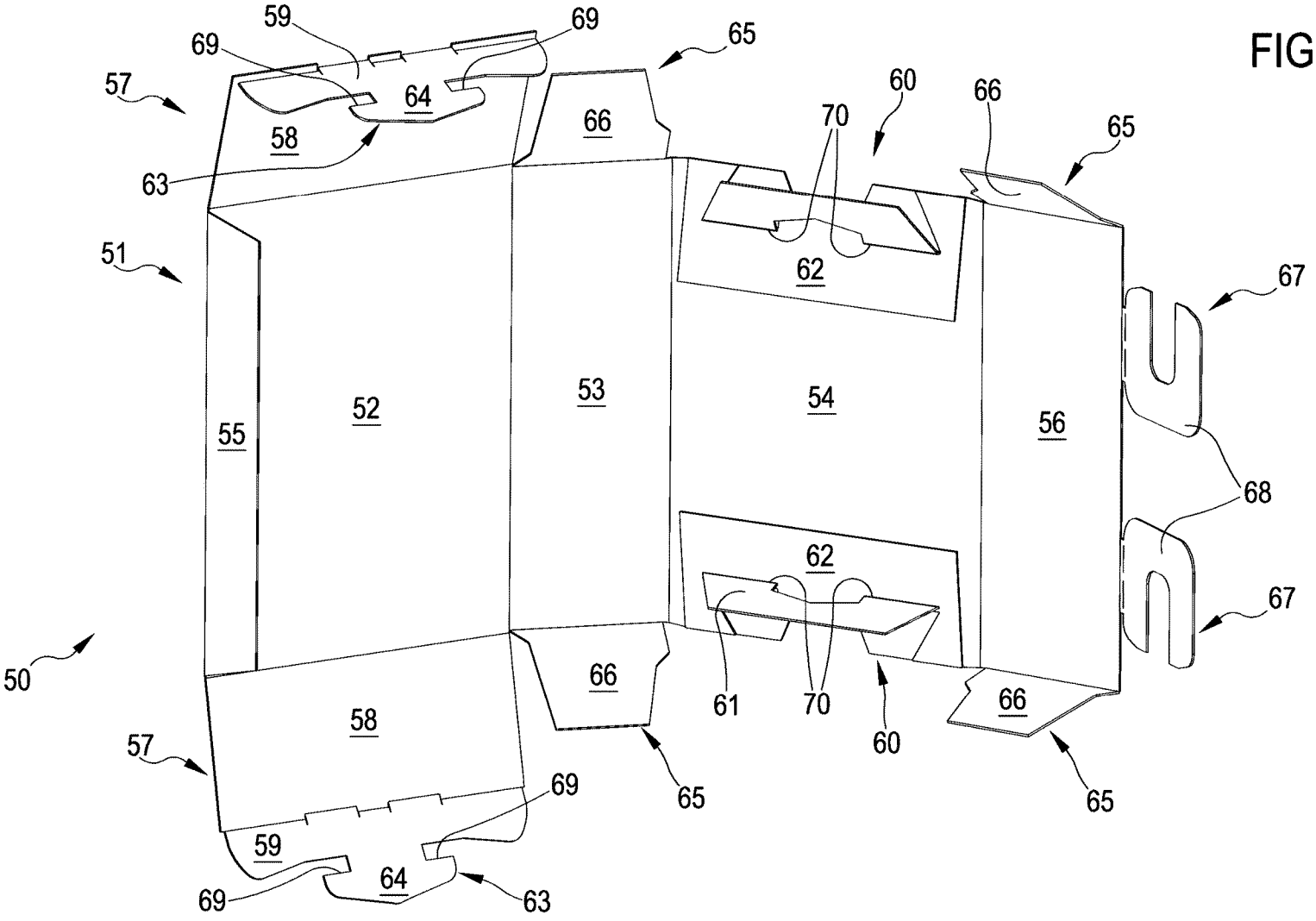
FIG. 2 schematically shows a step of folding the blank of FIG. 1 for making a container according to the present invention.

Providing the housing 2 further includes folding the first sheet 51 at the lateral edges of the portions 52, 54. Referring to FIG. 2, initially, forming the housing 2 includes folding the portion 55 (e.g., a lateral connecting portion with respect to the first portion 52 and toward the second portion 54. For example, the lateral connecting portion 55 can be folded to define a substantially "L" shape together with the first portion 52. Next, the process includes folding the first central portion 53 with respect to the first portion 52 towards the already folded portion 55. For example, the central portion 53 can be folded to define a substantially "L" shape together with the first portion 52.

Next, the process includes folding the second portion 54 with respect to the central portion 53 towards the first portion 52. For example, the second portion 54 can be folded to define a substantially "L" shape together with the central portion 53. To complete formation of the housing 2, the process further includes folding the portion 56 (e.g., the remaining lateral connecting portion) with respect to the second portion 54 so that it is possible to join said lateral connecting portions 55, 56, which are configured to abut each other. A predetermined amount of paste can be applied to the lateral connecting portions 55, 56 to maintain (e.g., lock) the housing 2 in its three-dimensional, folded shape. In some embodiments, providing the first sheet 51 includes a crushing step that defines folding lines on the first sheet 51 that are coincident with the longitudinal lateral edges of the portions of the first sheet 51. For example, the portions of the first sheet 51 are folded along the longitudinal lateral edges of the portions, which is aided by the crushed folding lines. Advantageously, the first sheet 51 is made of paper material.

The process further includes providing the closure 7. Providing the closure 7 includes providing at least one second sheet 57 that is advantageously joined to the first sheet 51, such as at an end edge of the first portion 52 of the first sheet 51. The second sheet 57 includes at least one first portion 58 and at least one second portion 59 that are integrally joined to each other. The first portion 58 of the second sheet 57 is connected to the first sheet 51 so that the first portion 58 is interposed between the second portion 59 of the second sheet 57 and first sheet 51. Referring to FIGS. 1, 2, 18, 19 and 21, in some embodiments, two second sheets 57 extend in opposite directions from the first sheet 51. For example, a second sheet 57 is connected to the upper edge 52*d* and/or lower edge 52*a* of the first portion 52 of the first sheet 51. Advantageously, the second sheet 57 is integral with the first sheet 51 in order to define a single sheet. In some embodiments, the second sheet 57 is made of paper material, such as the paper material from which the first sheet 51 is made.

The process further includes folding the first and second portions 58, 59 of the second sheet 57 for forming the closing portion 9 and the inserting portion 10 of the closure 7, respectively. Providing the second sheet 57 further includes forming one or more slits 15 made at the first and/or second portions 58, 59 that are configured to enable to insertion of the opening device 14. Forming one or more slits 15 includes making one or more slits 15*a* at the first and/or second portions 58, 59. For example, a respective slit 15 corresponds to each formed slit 15*a*.

In addition, the process further includes providing the safety device 11, which includes providing at least one third sheet 60 and at least one fourth sheet 63. Advantageously, the third sheet 60 is integrally joined to the first sheet 51, particularly at an end edge of the second portion 54 of the first sheet. The third sheet 60 includes a first portion 61 and a second portion 62. The first portion 61 is configured to provide the second hooking portion 13. While the housing 2 is formed, the third sheet 60 is integrally formed with the second portion 54 of the first sheet 51 and is folded against the second portion 54. The second portion 62 of the third sheet 60 and the second portion 54 of the first sheet 51 are configured to abut each other. The process further includes applying a predetermined amount of paste on the second portion 62 of the third sheet 60 and on a part of the second portion 54 of the first sheet 51 for joining the second portion 62 and the second portion 54 to define the second hooking portion 13 of the safety device 11. For example, the second hooking portion 13 is defined by folding the first portion 61 of the third sheet 60 away from the second portion 54 of the first sheet 51. Referring to FIGS. 1, 2, 18, 19 and 21, in some embodiments, two third sheets 60 extend from opposite ends of the first sheet 51. The third sheet 60 is for example directly connected to the upper edge 54*d* and/or to the lower edge 54*a* of the second portion 54 of the first sheet 51. Advantageously, the third sheet 60 is integrally joined to the first sheet 51 to provide a single sheet. In some embodiments, the third sheet 60 is made of paper material, such as the paper material sheet used to form the first sheet 51 and the second sheet 57.

Advantageously, the fourth sheet 63 is integrally joined to the second sheet 57, such as at an end edge of the second portion 59. The fourth sheet 63 includes a portion 64 integrally joined to the second portion 59 of the second sheet 57. The portion 64 provides the first hooking portion 12 of the safety device 11. In some embodiments, two fourth sheets 63 connected to respective second sheets 57 are provided. Advantageously, the fourth sheet 63 is integral with the second sheet 57 to provide a single sheet. In some embodiments, the fourth sheet 63 is made of paper material, such as the same paper material sheet used to form the first sheet 51, the second sheet 57, and third sheet 60.

The process further includes providing a fifth sheet 65 that is advantageously integrally joined to the central connecting portion 53 and/or to the second lateral connecting portion 56. The fifth sheet 65 includes a portion 66 that is configured to form the abutment portion 24. In some embodiments, four fifth sheets 65 are provided, where two of the fifth sheets 65 are connected to opposite edges of the central connecting portion 53, and two of the fifth sheets 65 are connected to opposite edges of the second lateral connecting portion 56. Advantageously, the fifth sheet 65 is integral with the first sheet 51 to provide a single sheet. In some embodiments, the fifth sheet 65 is made of paper material, such as the same paper material sheet used to form the first sheet 51, the second sheet 57, the third sheet 60, and the fourth sheet 63.

The process further includes providing a sixth sheet 67 that is advantageously integrally joined to the first sheet 51, such as at the first lateral connecting portion 55 of second lateral connecting portion 56. A weakening portion is provided between the sixth sheet 67 and first sheet 51 to aid separation of the sixth sheet 67 from the first sheet 51. The sixth sheet 67 includes a portion 68 that is configured to form the opening device 14. The process further includes shaping the sixth sheet 67 to define a single portion 68 including at least one gripping portion 30 from which at least one appendage 26 projects. In the embodiment illustrated in FIG. 18, the sixth sheet 67 includes lateral projections 75 adapted to define abutment edges 27 configured for preventing the opening device 14 from completely entering the inside of the slit 15. The abutment edges 27 are destined to contact respective abutment edges of the container 1 adjacent the slit 15 so that only the appendage 26 of the opening device 14 can be inserted into the slit 15.

Referring to FIGS. 1, 2, 18, 19, and 21, in some embodiments, the opening device 14 is integrally formed with the container 1 and can be separated from the container 1 before initially opening the container 1. Referring to FIGS. 1-3, 18, and 19, in some embodiments, two sixth sheets 67 are joined to the first sheet 51 at the second connecting portion 56. Advantageously, the sixth sheet 67 is integral with the first sheet 51 to provide a single sheet. In some embodiments, the sixth sheet 67 is made of paper material, such as the same paper material sheet used to form the first sheet 51, the second sheet 57, the third sheet 60, the fourth sheet 63, and the fifth sheet 65. While the first sheet 51 is folded, the sixth sheet 67 remains outside of the inner volume 3 of the housing 2 so that, once the container 1 is closed, the portion 68 can be separated from the first sheet 51 to open the container 1.

Referring to FIG. 21, in some embodiments, the process includes providing seventh and eighth sheets 71, 72 including respective portions 73, 74 that are configured to be joined to each other. The seventh sheet 71 extends from the second lateral connecting portion 56 of the first sheet 51, while the eighth sheet 72 extends from the portion 73 of the seventh sheet 71. According to such embodiment, the sixth sheet 67 is connected to the seventh and/or eighth sheets 71, 72.

Advantageously, the seventh sheet 71 is integrally joined to the first sheet 51 to provide a single sheet. In some embodiments, the seventh sheet 71 is made of paper material, such as the same paper sheet material used to form the first sheet 51, the second sheet 57, the third sheet 60, the fourth sheet 63, the fifth sheet 65, and the sixth sheet 67. Advantageously, the eighth sheet 72 is integrally joined to the seventh sheet 71 to provide a single sheet. In some embodiments, the eighth sheet 72 is made of paper material, such as the same paper sheet material used to form the first sheet 51, the second sheet 57, the third sheet 60, the fourth sheet 63, the fifth sheet 65, the sixth sheet 67, and the seventh sheet 71. According to the embodiment illustrated in FIG. 19, the sixth sheet 67 can be integral with the seventh and eighth sheets 71, 72.

During the process of making the container 1, the portion 73 of the seventh sheet 71 and portion 74 of the eighth sheet 72 are joined to each other, either before or after forming the housing 2. In some embodiments, the process includes applying a predetermined amount of paste on the portions 73, 74 to join the portions 73, 74 in the folded arrangement. In this way, the portions 73, 74 substantially provide the covering portion 29 and/or the case 25, as previously described.

The process further includes providing the safety device 11, which includes forming the first and second hooking portions 12, 13. In some embodiments, the safety device 11 is made of paper sheet material. Providing the safety device 11 also includes forming the undercuts 69, 70, which are substantially, respectively adapted to define the undercuts 16, 17 of the container 1. The undercuts 16, 17 are respectively defined at the first and second hooking portions 12, 13 and are adapted to be engaged with each other for providing the closed configuration of the container 1. In some embodiments, the first hooking portion 12 includes two undercuts 16 symmetrically arranged with respect to a midline of the first hooking portion 12, and the second hooking portion 13 includes two respective undercuts 17 symmetrically arranged with respect to a midline of the second hooking portion 13. Forming the undercuts 16, 17 includes forming at least one hook 18, 20. In some embodiments, the hook 20 is formed on the undercut 16, and the hook 18 is formed on the undercut 17. Forming the hook 18 further includes forming the seat 19 against which the first hooking portion 12 can abut.

Process for Opening and Closing a Container

The container 1 is configured for being closed by manually or automatically actuating the closure 7 and the safety device 11. For closing the container 1, the closing portion 9 is rotated about the free edge 6 of the housing 2 to move the inserting portion 10 inside of the housing 2. The first hooking portion 12 is inserted between the second hooking portion 13 and the wall 4 of the housing 2 to which the second hooking portion 13 is connected. Such insertion enables the undercuts 16 of the first hooking portion 12 to engage the undercuts 17 of the second hooking portion 13 to arrive at the arrangement illustrated in FIG. 6. The above described closing process refers to closing the opening 5. If another opening 5 with a respective closure 7 and safety device 11 is provided in the container 1, the above described process can be performed in the same way for closing the additional opening 5. According to the present disclosure, the container 1 cannot be opened merely by applying an opening force to the closure 7, alone. Rather, it is necessary to use the opening device 14 to open the container 1.

Figure 10:
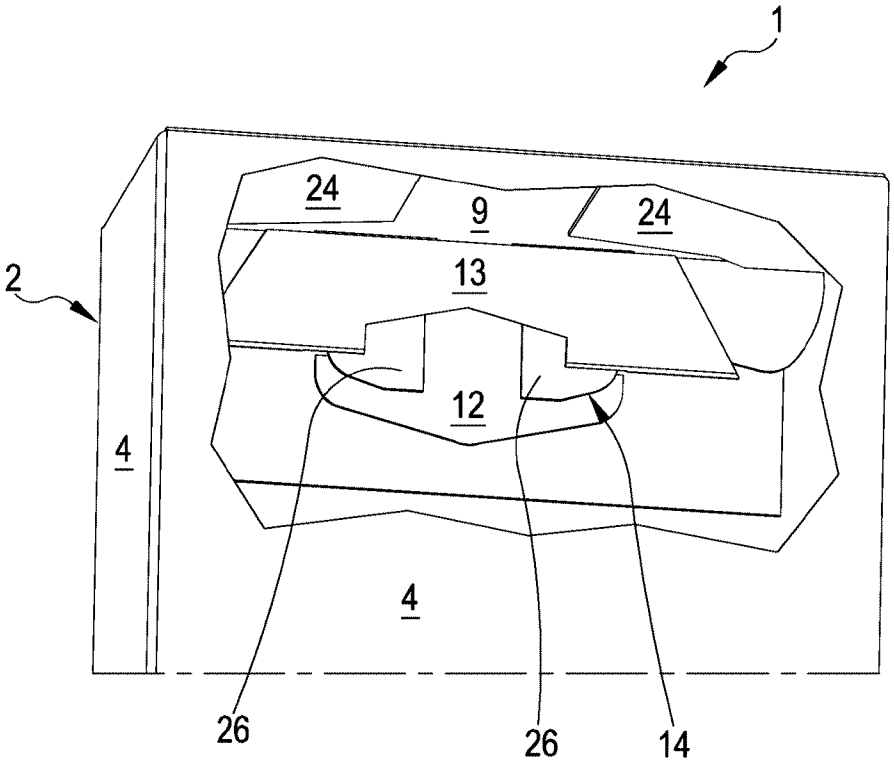
FIGS. 9 and 10 are further schematic views of a container according to the present invention during an opened condition of the same.
Figure 9:
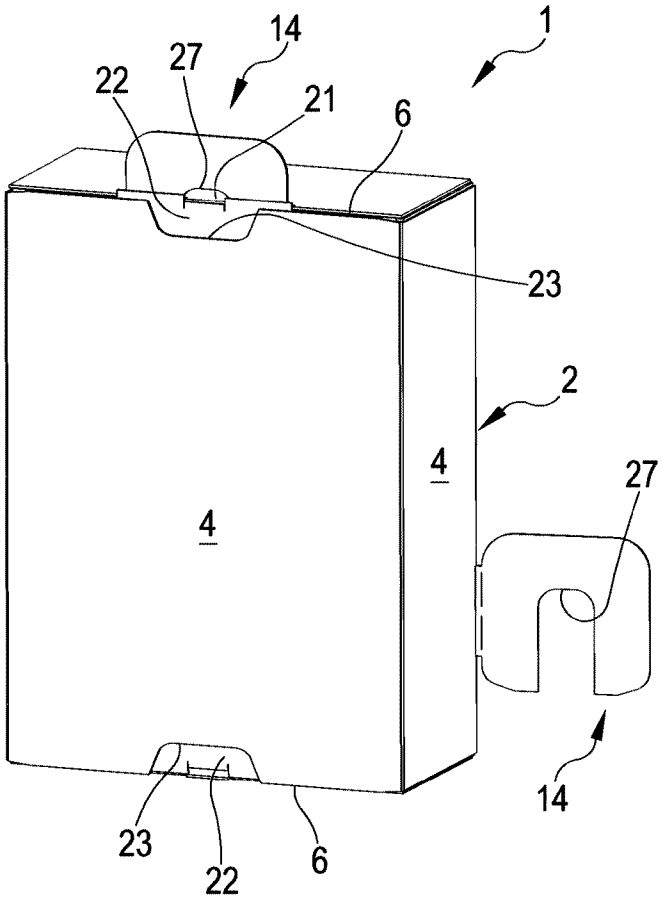

To open the container 1, the opening device 14 is at least partially inserted into one or more slits 15 of the container 1, as shown in FIG. 8. When the opening device 14 is inserted, the opening device 14 contacts the first and second hooking portions 12, 13, which causes disengagement of the undercuts 16, 17 of the first and second hooking portions 12, 13 on account of the opening device 14 moving between the hooking portions 12, 13. For example, as shown in FIG. 10, the opening device 14 is inserted inside of the slits 15 and extends inside of the housing 2 between the first and second hooking portions 12, 13. In such a configuration, the first and second hooking portions 12, 13 are disengaged, and the container 1 can be opened.

To open the container 1, it is necessary to act on the closure 7 by applying an opening force to the tab 8 (e.g., at the actuating portion 22) to rotate the tab 8 with respect to the free edge 6 of the housing 2. The force for opening the actuating portion 22 should be applied when the opening device 14 is engaged at the slits 15 to correctly open the container 1 (e.g., when the first and second hooking portions 12, 13 are disengaged). In order to open the container 1, the tab 8 is therefore integrally moved with the opening device 14. Moving the tab 8 determines the movement of the overall closure 7 integrally with the opening device 14. Such movement enables opening of the container 1.

In other words, the container 1 is configured for being opened exclusively by means of the opening device 14 which acts as a disengagement mechanism between the hooking portions 12, 13. The above described process for opening the container 1 is devised for preventing children from opening the container 1, especially children younger than 5 years old. When the container 1 is open, closing the container 1 requires disengaging the opening device 14 from the slits 15 so that the first hooking portion 12 can reengage the second hooking portion 13 after moving the tab 8 about the free edge 6 of the housing 2.

Advantages

The container 1 is childproof and can effectively prevent children from gaining access, while yet having a simple and compact structure. The container 1 can be opened only using the opening device 14. It is not possible to open the container 1 without the opening device 14. However, using the opening device 14, the container 1 can be opened in a simple, fast, and effective way.

Therefore, the childproof container 1 is advantageously configured for maintaining the closed configuration (i.e., the safety configuration) despite attempts to open the container 1 without the opening device 14. Moreover, the material formulation of opening device 14 (e.g., paper material) makes the opening device 14 easily recyclable and/or biodegradable.

Moreover, the container 1 provides a light and compact container 1 that maintains its integrity after plural openings and closings of the container 1. In this way, it is possible to place the container 1 back in the safety configuration after opening such that the container 1 can be subsequently opened only using the opening device. Moreover, the container 1 can be both manually and automatically closed using packaging machines available on the market.

The invention claimed is:

1. A child-proof container, comprising:

a housing defining an inner volume configured to house a product, the housing including a plurality of lateral walls defining an opening delimited by an edge and configured to communicate the inner volume of the housing with an external environment;

a closure, connected to the edge, and movable with respect to the housing, the closure being configured to define a closed configuration in which the inner volume of the housing cannot communicate with the external environment and configured to define an open configuration in which the inner volume of the housing can communicate with the external environment, the closure comprising a tab having a closing portion connected to the edge of the housing and movable with respect to the housing, the tab further comprising an inserting portion configured to be inserted inside of the inner volume of the housing in the closed configuration of the closure; and a safety device, comprising:

a first hooking portion carried by the tab, a second hooking portion connected to the housing and configured to cooperate with the first hooking portion, the first and second hooking portions being configured to stably engage each other in the closed configuration of the closure to effect a safety configuration that prevents unintentional opening of the closure from the closed configuration, wherein the closure defines a slit by which the closure can be opened from the safety configuration, wherein the first and second hooking portions are configured to reversibly engage such that the closure can be switched back and forth between the open and safety configurations, and wherein the child-proof container further comprising an opening device configured to be inserted into the slit to disengage the first and second hooking portions from each other to enable the closure to be opened from the safety configuration.

2. A child-proof container according to claim 1, wherein the opening device is configured to be inserted inside of the housing between the first and second hooking portions to disengage the first and second hooking portions from each other.

3. A child-proof container according to claim 1, wherein the closure is configured to be opened from the closed configuration when the opening device is disposed between the first and second hooking portions.

4. A child-proof container according to claim 1, wherein the first hooking portion defines a first undercut, and the second hooking portion defines a second undercut, wherein the first and second hooking portions are configured such that the first and second undercuts abut each other in the safety configuration of the child-proof container, wherein the second undercut comprises a second hook defining a second seat having a second concavity that faces a first lateral wall of the housing, and wherein the first hooking portion is configured to stably engage the second seat of the second hook the closed configuration of the child-proof container.

5. A child-proof container according to claim 4, wherein the first undercut of the first hooking portion comprises a first hook defining a first seat having a first concavity that, in the safety configuration, faces the second concavity of the second seat of the second hook of the second hooking portion.

6. A child-proof container according to claim 1, wherein the slit is defined by one or both of a cutout positioned along the edge of the housing and the inserting portion of the closure and an opening defined by the inserting portion of the closure and a lateral wall of the housing that carries the second hooking portion.

7. A child-proof container according to claim 1, wherein the second hooking portion is parallel to a lateral wall of the housing that faces the inserting portion in the closed configuration of the child-proof container.

8. A child-proof container according to claim 1, wherein the first hooking portion is integral with the inserting portion, and wherein the first hooking portion is disposed opposite the closing portion of the tab.

9. A child-proof container according to claim 1, wherein the second hooking portion is connected to a lateral wall of the plurality of lateral walls that faces the inserting portion in the closed configuration of the child-proof container.

10. A child-proof container according to claim 1, wherein the opening device comprises a gripping portion and an appendage extending from the gripping portion, wherein the appendage has a polygonal shape and is configured to be inserted inside of the slit, and wherein the opening device is configured such that the appendage is disposed between the first and second hooking portions when the appendage is inserted inside of the slit.

11. A child-proof container according to claim 1, wherein the child-proof container is configured such that the second hooking portion is disposed inside of the inner volume of the housing.

12. A child-proof container according to claim 1, wherein the inserting portion is disposed inside of the inner volume of the housing in the closed configuration.

13. A child-proof container according to claim 1, wherein the first hooking portion is disposed inside of the inner volume of the housing in the closed configuration.

14. A child-proof container according to claim 1, wherein the first hooking portion is spaced apart from the free edge of the housing in the closed configuration.

15. A child-proof container according to claim 1, wherein an engagement between the first and second hooking portions is disposed inside of the inner volume of the housing.

16. A child-proof container according to claim 1, wherein one or more of the housing, the closure, and the safety device is formed from sheet material.

17. A child-proof container, comprising:

a housing defining an inner volume configured to house a product, the housing including a plurality of lateral walls defining an opening delimited by an edge and configured to communicate the inner volume of the housing with an external environment;

a closure, connected to the edge, and movable with respect to the housing, the closure being configured to define a closed configuration in which the inner volume of the housing cannot communicate with the external environment and configured to define an open configuration in which the inner volume of the housing can communicate with the external environment, the closure comprising a tab having a closing portion connected to the edge of the housing and movable with respect to the housing, the tab further comprising an inserting portion configured to be inserted inside of the inner volume of the housing in the closed configuration of the closure; and a safety device, comprising:

a first hooking portion carried by the tab, a second hooking portion connected to the housing and configured to cooperate with the first hooking portion, the first and second hooking portions being configured to stably engage each other in the closed configuration of the closure to effect a safety configuration that prevents unintentional opening of the closure from the closed configuration, wherein the closure defines a slit by which the closure can be opened from the safety configuration, and wherein the first and second hooking portions are configured to reversibly engage such that the closure can be switched back and forth between the open and safety configurations;

wherein the first hooking portion defines a first undercut, and the second hooking portion defines a second undercut, wherein the first and second hooking portions are configured such that the first and second undercuts abut each other in the safety configuration of the child-proof container, wherein the second undercut comprises a second hook defining a second seat having a second concavity that faces a first lateral wall of the housing, and wherein the first hooking portion is configured to stably engage the second seat of the second hook the closed configuration of the child-proof container.

18. A child-proof container according to claim 17, wherein the first undercut of the first hooking portion comprises a first hook defining a first seat having a first concavity that, in the safety configuration, faces the second concavity of the second seat of the second hook of the second hooking portion.

19. A child-proof container according to claim 17, wherein the second hooking portion is parallel to a lateral wall of the housing that faces the inserting portion in the closed configuration of the child-proof container.

* * * * *